US008398126B2

(12) United States Patent
Nakanishi et al.

(10) Patent No.: US 8,398,126 B2
(45) Date of Patent: Mar. 19, 2013

(54) MULTIPOINT LOCK MECHANISM

(75) Inventors: Yoshikazu Nakanishi, Tokyo (JP); Manabu Shimoji, Tokyo (JP)

(73) Assignee: Truth Hardware Corporation, Owatonna, MN (US)

( * ) Notice: Subject to any disclaimer, the term of this patent is extended or adjusted under 35 U.S.C. 154(b) by 932 days.

(21) Appl. No.: 12/124,823

(22) Filed: May 21, 2008

(65) Prior Publication Data

US 2009/0019779 A1 Jan. 22, 2009

Related U.S. Application Data

(60) Provisional application No. 60/939,211, filed on May 21, 2007, provisional application No. 60/944,259, filed on Jun. 15, 2007.

(51) Int. Cl.
*E05C 19/10* (2006.01)
*E05C 1/00* (2006.01)

(52) U.S. Cl. ..... 292/100; 292/1.5; 292/DIG. 60

(58) Field of Classification Search ..... 292/1.5, 292/100, 341.18, 341.19, DIG. 46, DIG. 53, 292/DIG. 60; 70/461; 49/449
See application file for complete search history.

(56) References Cited

U.S. PATENT DOCUMENTS

| | | | | |
|---|---|---|---|---|
| 504,292 | A * | 8/1893 | Badoni | 70/448 |
| 540,911 | A | 6/1895 | George | |
| 614,144 | A | 11/1898 | Thompson | |
| 912,378 | A | 2/1909 | Jackson | |
| 932,330 | A | 8/1909 | Rotchford | |
| 958,880 | A | 5/1910 | Lawson | |
| 1,023,766 | A | 4/1912 | Sinclair | |
| 1,051,918 | A | 2/1913 | Rowley | |
| 1,065,172 | A | 6/1913 | Riggs | |
| 1,070,366 | A | 8/1913 | Voight | |
| 1,078,549 | A | 11/1913 | Northey | |
| 1,174,652 | A | 3/1916 | Banks | |
| 1,216,765 | A | 2/1917 | Anderson | |
| 1,320,444 | A | 11/1919 | Bucznyski | |
| 1,334,314 | A | 1/1920 | Parsons | |
| 1,385,102 | A | 7/1921 | Winters et al. | |
| 1,402,964 | A | 1/1922 | Robertson | |
| 1,515,611 | A | 11/1924 | O'Connor | |
| 1,533,243 | A | 4/1925 | Galterio | |
| 1,585,689 | A | 5/1926 | Piggot | |

(Continued)

FOREIGN PATENT DOCUMENTS

| | | | |
|---|---|---|---|
| DE | 1095709 | B | 12/1960 |
| DE | 2914377 | A1 | 10/1980 |
| DE | 10255733 | A1 | 6/2004 |
| EP | 117744 | A2 | 9/1984 |
| EP | 0359284 | A2 | 3/1990 |

(Continued)

OTHER PUBLICATIONS

Rejuvenation, Large Brass Casement Window Fastener 8389, www.rejuvenation.com , Mar. 3, 2005, 1 Pg.

(Continued)

*Primary Examiner* — Carlos Lugo
(74) *Attorney, Agent, or Firm* — Patterson Thuente Pedersen, P.A.

(57) ABSTRACT

A multipoint lock for sliding doors. The multipoint lock mounted to a sliding door generally includes an active locking device having an active latch, and two passive locking devices, each having a passive latch. The latches are independently depth adjustable relative to an edge of the sliding door. The active locking device further includes sets of fastener apertures for receiving and securing a handle assembly thereto in at least two different positions. A lever having an actuator pin of the handling assembly can be positioned at various locations on the handle assembly such that fastener apertures of the handle assembly align with a different set of handle apertures of the active locking device depending on the position of the lever, Actuation of the active locking device by movement of the lever shifts the active latch and the passive latches simultaneously between locked and unlocked positions.

8 Claims, 13 Drawing Sheets

U.S. PATENT DOCUMENTS 1,672,076 A * 6/1928 Munson ..... 70/461
2,033,079 A 3/1936 Lohrs
2,066,705 A 1/1937 Vazquez
2,159,315 A 5/1939 Blue
2,166,535 A 7/1939 Särenholm et al.
2,406,459 A 8/1946 Gibson
2,498,508 A 2/1950 Rudolph
2,701,157 A 2/1955 Le Bon, III
2,712,464 A 7/1955 Collar et al.
2,736,185 A 2/1956 Collar
2,823,941 A 2/1958 Ellis
2,855,234 A 10/1958 Eads
2,924,475 A 2/1960 Russell
2,943,514 A 7/1960 Golde
2,980,458 A 4/1961 Russell
3,041,097 A 6/1962 Eads
3,107,113 A * 10/1963 Sconzo ..... 292/228
3,195,171 A * 7/1965 Klein ..... 16/90
3,342,516 A 9/1967 Morand
3,400,562 A 9/1968 Bloss
3,543,441 A 12/1970 La Porte
3,586,360 A 6/1971 Perrotta
3,596,954 A 8/1971 Hull et al.
3,666,306 A 5/1972 Genakis
3,949,525 A 4/1976 Bates et al.
3,953,061 A 4/1976 Hansen et al.
4,050,272 A 9/1977 Tanaka
4,068,874 A 1/1978 Fleming et al.
4,118,056 A 10/1978 Alexander
4,148,106 A 4/1979 Gallien
4,253,688 A 3/1981 Hosooka
4,335,816 A 6/1982 Rager
4,389,061 A 6/1983 Foshee
4,434,635 A 3/1984 Borgato
4,476,700 A 10/1984 King
4,480,862 A 11/1984 Fleming
4,547,006 A 10/1985 Castanier
4,602,457 A 7/1986 Kreusel
4,639,021 A 1/1987 Hope
4,643,005 A 2/1987 Logas
4,676,537 A 6/1987 Esser
4,739,583 A 4/1988 Tönsmann et al.
4,803,808 A 2/1989 Greisner
4,958,508 A 9/1990 Lin
4,962,653 A 10/1990 Kaup
4,973,091 A 11/1990 Paulson et al.
4,980,946 A 1/1991 Verasani et al.
4,988,133 A 1/1991 Shih
4,991,886 A 2/1991 Nolte et al.
5,045,265 A 9/1991 Pettit
5,058,938 A 10/1991 Döring et al.
5,078,200 A 1/1992 Guntermann et al.
5,087,087 A 2/1992 Vetter et al.
5,118,145 A 6/1992 Tucker
5,120,094 A 6/1992 Eaton et al.
5,183,310 A 2/1993 Shaughnessy
5,197,771 A 3/1993 Kaup et al.
5,245,846 A 9/1993 James
5,253,903 A 10/1993 Daley
5,290,077 A 3/1994 Fleming
5,301,525 A 4/1994 Döring
5,370,428 A 12/1994 Dreifert et al.
5,373,716 A 12/1994 MacNeil et al.
5,388,875 A 2/1995 Fleming
5,495,731 A 3/1996 Riznik
5,498,038 A 3/1996 Simon et al.
5,524,941 A 6/1996 Fleming
5,524,942 A 6/1996 Fleming
5,531,492 A 7/1996 Raskevicius
5,542,720 A 8/1996 Fleming
5,603,538 A 2/1997 Evers
5,620,261 A 4/1997 Fuller
5,642,909 A 7/1997 Swan et al.
5,722,704 A 3/1998 Chaput et al.
5,741,031 A 4/1998 Bauman et al.
5,752,727 A 5/1998 Zues et al.
5,778,602 A 7/1998 Johnson et al.
5,782,114 A 7/1998 Zeus
5,791,790 A 8/1998 Bender et al.
5,813,255 A 9/1998 Tell et al.
5,820,170 A 10/1998 Clancy
5,820,177 A 10/1998 Moon
5,839,767 A 11/1998 Piltingsrud
5,878,605 A 3/1999 Renz
5,878,606 A 3/1999 Chaput et al.
5,896,763 A 4/1999 Dinkelborg et al.
5,901,989 A 5/1999 Becken et al.
5,906,403 A 5/1999 Bestler et al.
5,927,767 A 7/1999 Smith et al.
5,951,068 A 9/1999 Strong et al.
6,006,560 A 12/1999 DeVries
6,045,169 A 4/2000 Frolov
6,135,511 A 10/2000 Smith et al.
6,161,881 A 12/2000 Babka et al.
6,209,931 B1 4/2001 Von Stoutenborough et al.
6,217,087 B1 4/2001 Fuller
6,266,981 B1 7/2001 Von Resch et al.
6,282,929 B1 9/2001 Eller et al.
6,324,876 B1 12/2001 Prevot et al.
6,327,881 B1 12/2001 Grundler et al.
6,349,982 B2 2/2002 Fayngersh et al.
6,354,121 B1 3/2002 Frolov
6,367,853 B1 4/2002 Briggs
6,389,855 B2 5/2002 Renz et al.
6,393,878 B1 5/2002 Fayngersh et al.
6,557,909 B2 5/2003 Morris
6,651,389 B2 11/2003 Minter et al.
6,651,466 B1 11/2003 Shih
6,682,109 B2 1/2004 Horne et al.
6,688,656 B1 2/2004 Becken
6,837,004 B2 1/2005 Annes
6,871,451 B2 3/2005 Harger et al.
6,871,884 B2 3/2005 Hoffmann et al.
6,962,377 B2 11/2005 Tönges
6,971,686 B2 12/2005 Becken
7,003,990 B2 2/2006 Iliuk
7,004,515 B2 2/2006 Timothy
7,025,394 B1 4/2006 Hunt
7,108,300 B2 9/2006 Hodgin et al.
7,178,839 B2 * 2/2007 Tsai ..... 292/51
7,303,215 B2 12/2007 Moon et al.
7,418,845 B2 * 9/2008 Timothy ..... 70/100
7,510,222 B2 3/2009 Hodgin et al.
7,752,875 B2 7/2010 Constantiou et al.
2004/0145189 A1 7/2004 Liu
2004/0245784 A1 12/2004 Tsai
2006/0071478 A1 * 4/2006 Denys ..... 292/26
2006/0087125 A1 4/2006 Moon et al.
2006/0091679 A1 5/2006 Tsai
2007/0096476 A1 5/2007 Vetter
2008/0265587 A1 * 10/2008 Nakanishi et al. ..... 292/26
2010/0327610 A1 * 12/2010 Nakanishi et al. ..... 292/162

FOREIGN PATENT DOCUMENTS

EP 0431369 A2 6/1991
EP 0327264 B1 12/1992
FR 2435586 4/1980
GB 2212849 A 8/1989
GB 2281097 A 2/1995
GB 2337556 A 11/1999
JP 2115482 A 4/1990
JP 10-121792 5/1998

OTHER PUBLICATIONS

Ferco Corp., Fittings for tilt-turn gears JET AS 130 Aluminium joinery, 1991, 12 Pgs.

Truth Hardware, Multi-Point Locking System, *Truth Hardware Catalog*, 1993, 8 Pgs., pp. 2.7-2.7g.

Truth Hardware, Engineering Drawing No. 31868, Nov. 3, 1996, 1 Pg.

Truth Hardware, Mirage™ Concealed Multi-Point Locking System (Tie Bar in Jamb version), *Truth Hardware Catalog*, 1996, 12 pgs., pp. 2.5-2.5k.

PCT Search Report dated Nov. 18, 2008, 2 Pgs.

* cited by examiner

MULTIPOINT LOCK MECHANISM

RELATED APPLICATIONS

The present application claims the benefit of U.S. Provisional Application No. 60/939,211 entitled MULTI-POINT LOCK MECHANISM, filed May 21, 2007, and to U.S. Provisional Application No. 60/944,259 entitled MULTI-POINT LOCK MECHANISM, filed Jun. 15, 2007, both of which are incorporated herein by reference in their entireties.

FIELD OF THE INVENTION

This application relates to door locks, and more specifically, to multipoint door locks for commercial doors, such as sliding doors.

BACKGROUND OF THE INVENTION

Multipoint locks for commercial doors, such sliding doors are well-known in the art. A multipoint lock generally includes an active lock assembly and one or more passive lock assemblies. Each of the lock assemblies can include a latch, or other similar device, that is releasably engageable with a receiving component, such as a keeper, positioned within a door jamb.

Generally, a handle assembly having an actuator pin is fastened to the active lock assembly at a pre-defined location through the positioning of fastener apertures located on the active lock assembly. Upon application of a force to a portion of the handle, such as a lever assembly, the actuator pin activates the locking mechanism in the active locking device, which in turn activates the locking mechanism in the passive locking devices such that the latches of each locking device simultaneously engage or disengage their corresponding receiving components.

However, these existing multipoint sliding door locks, however, have a number of disadvantages. For example, the active locking device of multipoint locks is not mountable to a handle set or handle sets having an actuator pin, or escutcheon, positioned differently in relation to fastening members of the handle set. The active and passive locking devices are unable to accommodate locks having different sizes. The depth of multiple locks within locking devices is not individually adjustable. The multipoint lock is unable to effectively translate relatively minimal rotation of the actuator pin into relatively large transverse displacement of lock components. Therefore, there is a need for a multipoint lock that overcomes these disadvantages.

SUMMARY OF THE INVENTION

The present invention addresses the aforementioned needs in providing a multipoint lock for a commercial door, such as a sliding door. In embodiments of the invention, an active locking device is operably connected to upper and lower passive locking devices. By rotating an actuator pin inserted into the active locking device, an operator can simultaneously engage depth-adjustable latches with the receiving components, or keepers, in a door jamb. Various components of the active locking device translate rotation of an actuator pin into transverse movements of other components that actuate the upper and lower passive locking devices. An anti-slam mechanism prevents the adjustable latches from occupying a locked position unless an anti-slam button is pushed, such as would occur when a sliding door is closed. The depths of the adjustable latches can be individually adjusted by rotating a depth-adjustment screw located in each of the locking devices.

In one embodiment of the invention, the multipoint locking device generally includes a faceplate secured to a door, an active locking assembly and a plurality of passive locking assemblies, each fastenable to the faceplate. The active locking assembly can include an active latch shiftable between a locked position and an unlocked position, at least two sets of handle fastener apertures, and a handle actuator pin aperture. The handle assembly can be mounted to the active locking assembly in at least two different positions relative to the door. The active locking assembly and each of the passive locking assemblies can further include depth-adjustment mechanism, including a depth-adjustment screw defining a screw head and a screw body; and a depth-adjustment bolt engaged with the screw body such that a position of the threaded depth-adjustment bolt on the screw body defines a depth position of the corresponding latch relative to the faceplate. Each of the latches can be independently adjusted.

In another embodiment of the invention a lockable sliding door assembly having a multipoint lock mechanism is mountable within a door jamb. The sliding door assembly can include a sliding door shiftable between an open and closed position, and while in the closed position, between an unlocked position and a locked position. A multipoint lock device, as described above, is mounted to an edge of the sliding door. A handle assembly including a lever and an actuator pin operably coupled to the lever is mounted to the multipoint lock device. The lever of the handle assembly is selectively positionable within channels defined along the body of the handle assembly. A set of handle fastener apertures of the locking device corresponds to a first position of the lever, such that the handle assembly is oriented in a first position relative to the sliding door. Other sets of handle fastener apertures correspond to second, third, or further positions of the lever such that the handle assembly is oriented in second, third or further different positions relative to the sliding door.

More particularly, in some embodiments of the invention, the handle assembly defines a set of fastener apertures. The channels are positioned between the set of fastener apertures. The set of fastener apertures on the handle assembly align with one set of the at least two sets of handle fastener apertures when the lever is positioned within a first channel, and the set of fastener apertures on the handle assembly align with a different set of the handle fastener apertures when the lever is positioned within a different channel from the first channel. The actuator pin aligns with the actuator pin aperture of the locking device when the lever is positioned within any one of the channels.

Figures 1, 1A:
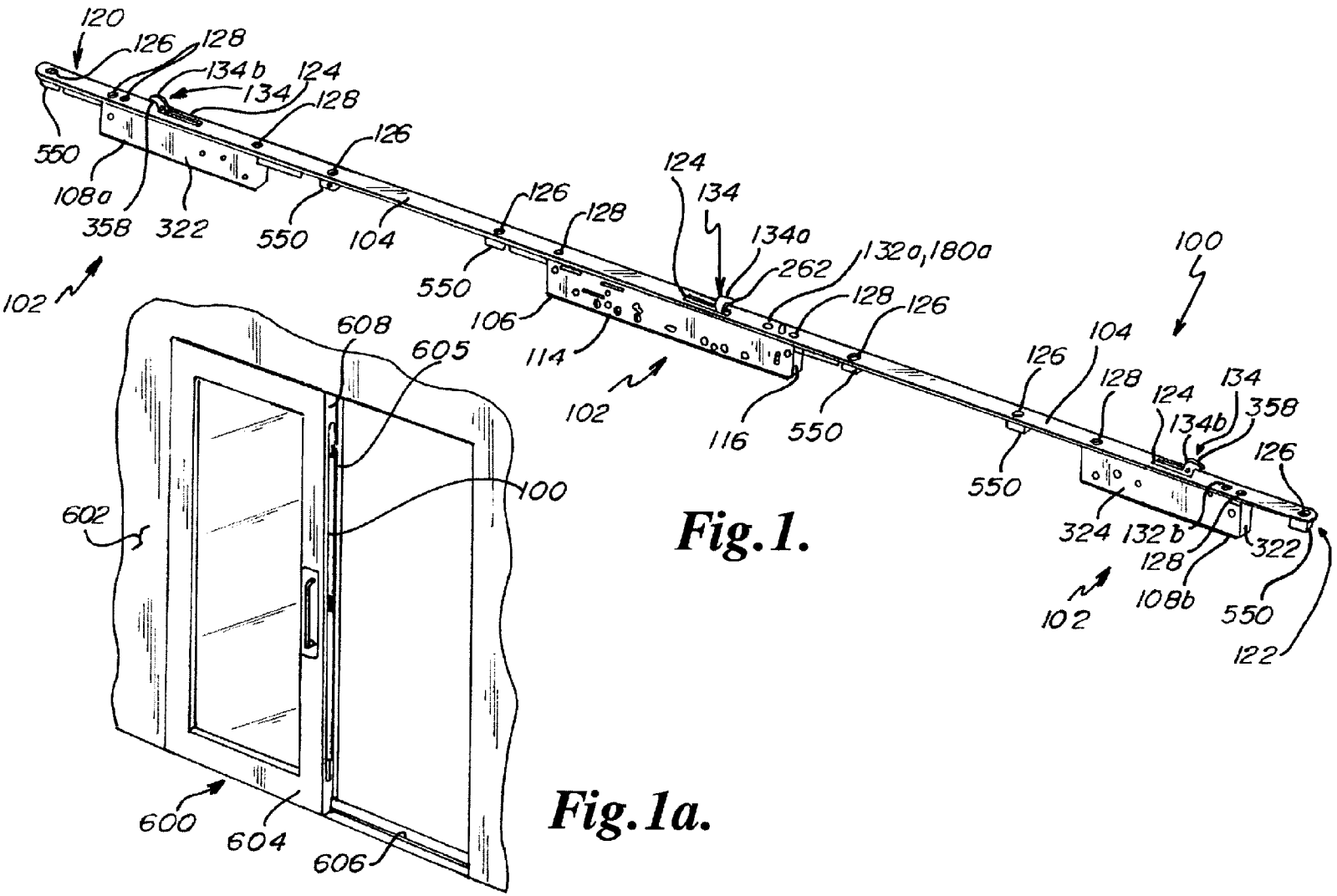
FIG. 1 is a perspective view depicting a multipoint sliding door lock according to an embodiment of the present disclosure.
FIG. 1*a* is a perspective view of a sliding door assembly according to an embodiment of the invention.

While the present invention is amendable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

As illustrated in FIG. 1, a multipoint sliding door lock 100 of the present disclosure can comprise lock assemblies 102, faceplate 104, and linking members 110. The components of multipoint sliding door lock 100 can be fabricated from suitable materials of construction, including, for example, carbon steel, stainless, aluminum, nylon, and combinations thereof.

As depicted in FIG. 1*a*, a sliding door assembly 600 according to an embodiment of the invention is disposed in an opening defined in a wall 602 of a structure and generally includes door panels 604, 605, slidably disposed in tracks 606. Lock assembly 100 is disposed in a mortise defined in a vertical side surface 608 of door panel 604.

Lock assemblies generally include active locking device 106 and passive locking devices 108. Passive locking devices 108 include upper passive locking device 108*a* and lower passive locking device 108*b*. Linking members 110 have teeth 111 and grooves 113. Active locking device 106 and upper passive locking device 108*a* are operably connected by upper linking member 110*a*. Active locking device 106 and lower passive locking device 108*b* can be operably connected by lower linking member 110*b*. Upper passive locking device 108*a* and lower passive locking device 108*b* are substantially similar passive locking devices 108 other than for their orientation on faceplate 104 in relation to active locking devices 106. Upper passive locking device 108*a* and lower passive locking device 108*b* can also include similar components and operate in a similar manner. Thus, description of upper passive locking device 108*a* can also describe lower passive locking device 108*b*, and vice versa.

The terms "upper" and "lower" used to describe passive locking devices 108 generally refer to positions in relation to a sliding door (not shown) on which multipoint sliding door lock 100 may be mounted. Upper passive locking device 108*a* is positioned near the top of a sliding door, while lower passive locking device 108*b* is positioned near the bottom of sliding door. The positions of upper passive locking device 108*a* and lower passive locking device 108*b* on a sliding door can also be switched without departing from the spirit or scope of the present invention.

Each lock assembly 102 generally comprises a discrete housing for enclosing, mounting, and protecting the functions performed by lock assembly 102. Active locking device 106 includes active locking-device base 112 secured to active locking-device cover 114. Upper passive locking device 108*a* includes passive locking-device base 116 secured to passive locking-device cover 118. Lower passive locking device 108*b* including passive locking-device base 116 secured to passive locking-device cover 118.

Faceplate 104 generally has top end 120, bottom end 122, latch channels 124, mounting holes 126, attachment holes 128, anti-slam actuator hole 130, and large depth-adjustment screw hole 132. Adjustable latches 134 can move within and through lock channels 124. Faceplate 104 can be mounted to a sliding door by way of suitable fasteners positioned within mounting holes 126. Suitable fasteners for this purpose can include screws, bolts, rivets, nails, adhesives, combinations thereof, and the like. As an optional feature, mounting holes 126 can provide for fasteners to be countersunk for greater aesthetic appeal and safety.

As illustrated in FIGS. 1-6, active locking device 106 can include active locking-device base 112, active locking-device cover 114, active latch 134*a*, crank member 136, active-lock positioner 138, gear-drive system 140, active-lock drive plate 142, active-lock actuator 144 defining lower linking-member engager 146, upper linking member-engager 148, anti-slam mechanism 150, depth-adjustment mechanism 152, and several connecting pins.

As illustrated in FIGS. 2-6 and 10-11, active locking-device base 112 can include main wall 154, front wall 156, back wall 158, top wall 160, and bottom wall 162. Main wall 154 has several slots, including back-gear protrusion slot (not shown), back-gear guide slot (not shown), spring post hole (not shown), and front-gear guide slot 164*a*. Main wall 154 also has crank-member hole (not shown), handle-fastener holes (not shown) and cog-protrusion hole 166*a*. Extending from main wall 154 toward active locking-device cover 114 are fastening posts 168, spring post 170, and anti-slam brace 172. Fastening posts 168 and spring post 170 are attached to main wall 154 using a suitable connection method, including, for example, welding, press-fit, and spin-fit techniques. Anti-slam brace 172 can be formed by bending toward active locking-device cover 114 a portion of main wall 112. Front wall 156 has attachment holes 174, small depth-adjustment screw hole 176, anti-slam protrusion hole 178 and active-latch opening 179. Attachment holes 174 of main wall 154 are generally aligned with attachment holes 128 of faceplate 104 so that fastening members are inserted through aligned attachment holes 128,174 to secure active locking-device base 112 to faceplate 104. Small depth-adjustment screw hole 176 of main wall 154 and large depth-adjustment screw hole 132*a* of faceplate 104 are generally aligned so as to receive depth adjustment screw 180*a*. Anti-slam protrusion hole 178 of front wall 156 is generally aligned with anti-slam actuator hole 130 of faceplate 104 so as to receive anti-slam actuator 182. In addition, active-latch opening 179 in front wall 156 of active locking-device base 112 is generally aligned with latch channel 124 of faceplate 104 so as to allow active latch 134*a* to freely pivot between locked and unlocked positions.

Figure 2:
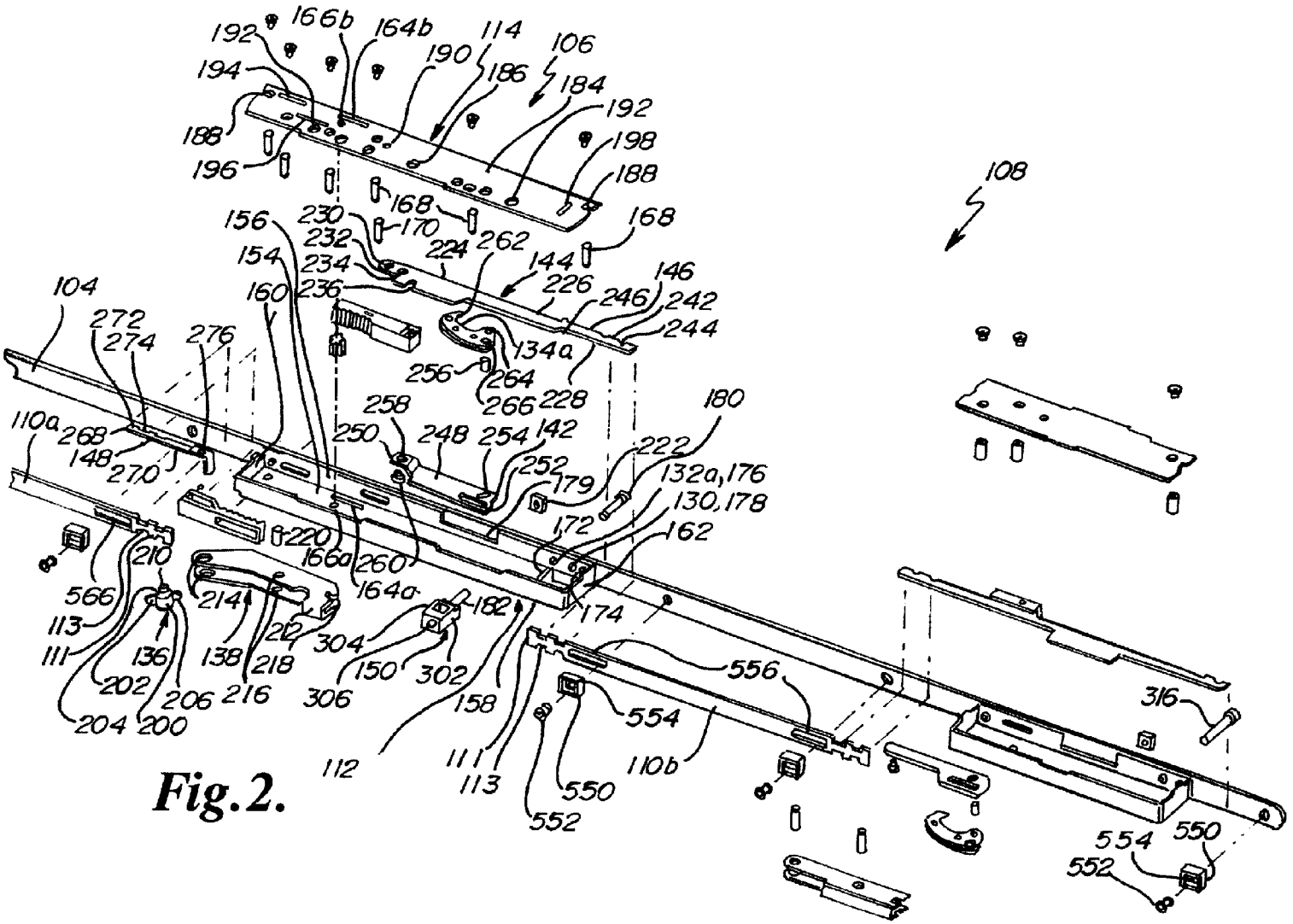
FIG. 2 is an exploded perspective view depicting an active locking device and a lower passive locking device according to an embodiment of the present disclosure.
Figure 3:
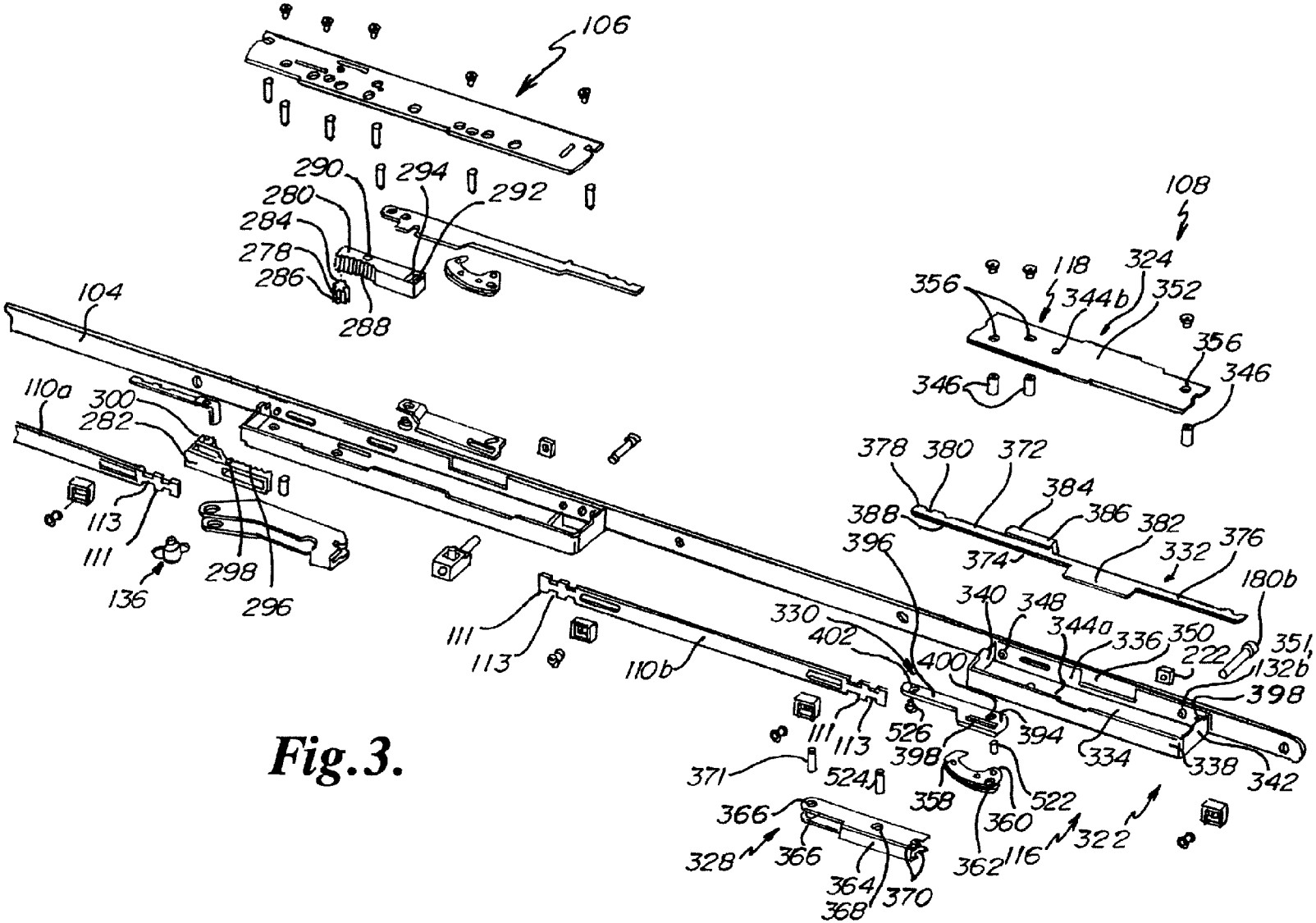
FIG. 3 is an exploded perspective view depicting an active locking device and a lower passive locking device according to an embodiment of the present disclosure.

As illustrated in FIGS. 2-3, active locking-device cover 114 can include cover plate 184 having a plurality of apertures and slots. The apertures includes crank-member hole 186, cover-screw holes 188, spring-post hole 190, handle-fastener holes 192, and cog-protrusion hole 166*b*. The slots include back-gear protrusion slot 194, back-gear guide slot 196, front-gear guide slot 164*b*, and anti-slam protrusion slot 198. Cover plate 184 has a shape so as to conformingly fit over front wall 156, back wall 158, top wall 160, and bottom wall 162 of active locking-device base 112. Generally, crank-member hole 186 is aligned with crank member 136, and cover-screw holes 188 are aligned with fastening posts 168, cog-protrusion hole 166*a* of active locking-device cover 114 is aligned with cog-protrusion hole 166*b* of active-locking device base 112 so as to allow active latch 134*a* to freely pivot between locked and unlocked positions. In addition, handle-fastener holes 192, back-gear protrusion slot 194, back-gear guide slot 196, and front-gear guide slot 164*b* of active locking-device cover 114 are generally aligned with handle-fastener holes (not shown), back-gear protrusion slot (not shown), back-gear guide slot (not shown), and front-gear guide slot 164*a* of active locking-device base 112 so as to allow active latch 134*a* to freely pivot between locked and unlocked positions.

As illustrated in FIGS. 2-6, crank member 136 can include crank body 200, top crank arm 202, middle crank arm 204, and bottom crank arm 206. Crank body 200 generally defines actuator-pin slot 206 and crank-arm protrusion 210. Top crank arm 202 and bottom crank arm 206 generally define spring holes 208*a,b*. Middle crank arm 204 generally defines crank-arm protrusion 210.

As illustrated in FIGS. 2-6, active-lock positioner 138 can comprise positioner housing 212 generally defining crank holes 214, small pivot-pin holes 216, and adjustment-bolt recesses 218. Crank holes 214 rotatably receive crank member 136. Small pivot-pin holes 216 can fixedly receive pivot pin 220. Adjustment-bolt recess 218 can rotatably receive threaded depth-adjustment bolt 222.

As illustrated in FIGS. 2-6, active-lock actuator 144 can include upper engagement region 224, middle region 226, and lower engagement region 228. Upper engagement region 224 generally defines actuator extension 230 defining front-gear protrusion hole 232, small actuator-pin hole 234, and crank-protrusion recess 236. Middle region 226 generally defines lock-channel cover 238. Lower engagement region 228 generally defines lower linking member engager 146 defining teeth 242 and grooves 244. The interface between middle region 226 and lower engagement region 228 defines anti-slam recess 246.

As illustrated in FIGS. 2-6, active-lock drive plate 142 can include drive-plate body 248 and drive-plate head 250. Drive-plate body 248 and drive-plate head 250 can occupy different planes. Drive plate body 248 generally defines pivot-pin slot 252 and drive-pin slot 254. Pivot-pin slot 252 can transversely receive pivot pin 220 along a lateral axis. Drive-pin slot 254 can transversely receive drive pin 256 along longitudinal and lateral axes. Drive-plate head 250 generally defines large actuator-pin hole 258. Large actuator-pin hole 258 can rotatably receive actuator rivet 260.

As illustrated in FIGS. 2-3, active latch 134*a* can include hook 262, drive-pin hole 264, and large pivot-pin hole 266. Hook 262 is generally shaped so to engage a keeper (not shown) when active latch 134*a* is in a locked position. Drive-pin hole 264 can receive drive pin 256. Large pivot-pin hole 266 can rotatably receive pivot pin 220.

As illustrated in FIGS. 2-6, upper-linking member engager 148 can include an upper region 268 and a lower region 270. Upper region generally defines teeth 272 and groves 274. Lower region 270 generally defines back-gear protrusion hole 276. Lower region 270 is bent toward main wall 154 of active locking-device base 112 to further secure upper linking member engager 148 within active locking device 106.

As illustrated in FIGS. 2-6, and particularly FIG. 3, gear-drive system 140 can include cog 278, front gear drive 280, back gear drive 282. Cog 278 generally defines cog protrusions 284 and gears 286. Cog-protrusion holes 166*a-b* of main wall 154 and cover plate 184 can rotatably receive cog-protrusions 284. Front gear-drive 280 generally defines gears 288, front-gear guides 290, front-gear recess 292, and front-gear protrusion 294. Gears 288 of front-gear drive 280 rotatably engage gears 286 of cog 278. Front-gear guide slots 164*a-b* transversely receives front-gear guides 290 so as to allow active latch 134*a* to freely pivot between locked and unlocked positions. Front-gear recess 292 can receive actuator extension 230 so that front-gear protrusion hole 232 receives front-gear protrusion 294. Back gear drive 282 generally defines gears 296, back-gear guides 298, and back-gear protrusion 300. Gears 286 of cog 278 rotatably engage gears 296 of back-gear drive 282. Back-gear guide slots 196 transversely receive back-gear guides 298 so as to allow active latch 134*a* to freely pivot between locked and unlocked positions. Back-gear protrusion hole 276 of upper linking member engager 270 receives back-gear protrusion 300.

Figure 4:
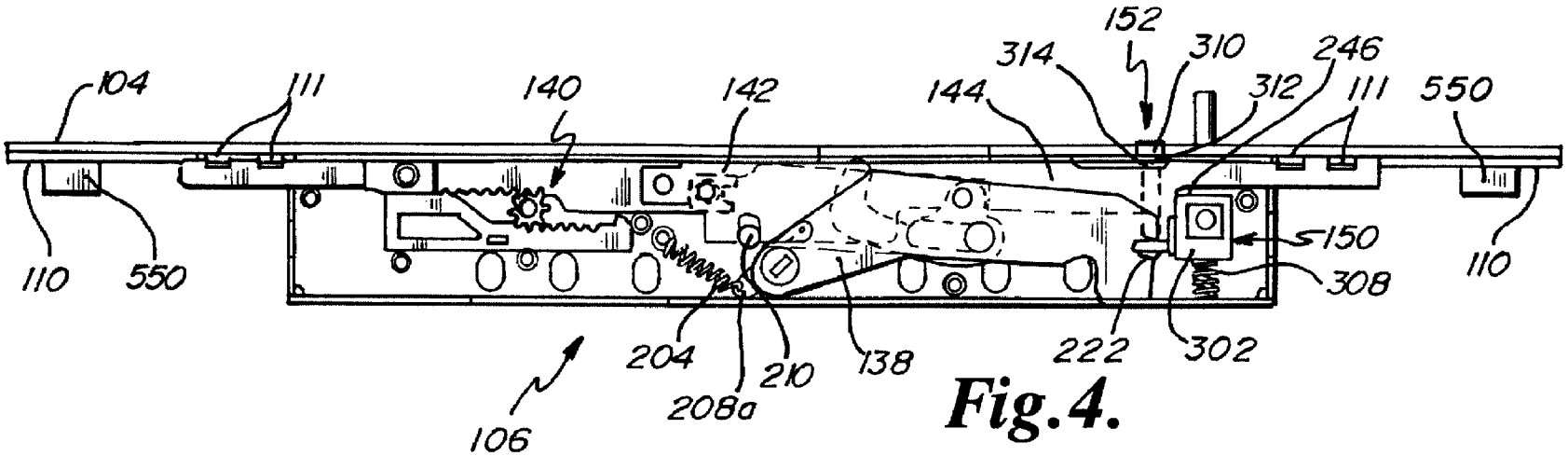
FIG. 4 is cross-sectional view depicting an active locking device in an unlocked position according to an embodiment of the present disclosure.
Figure 5:
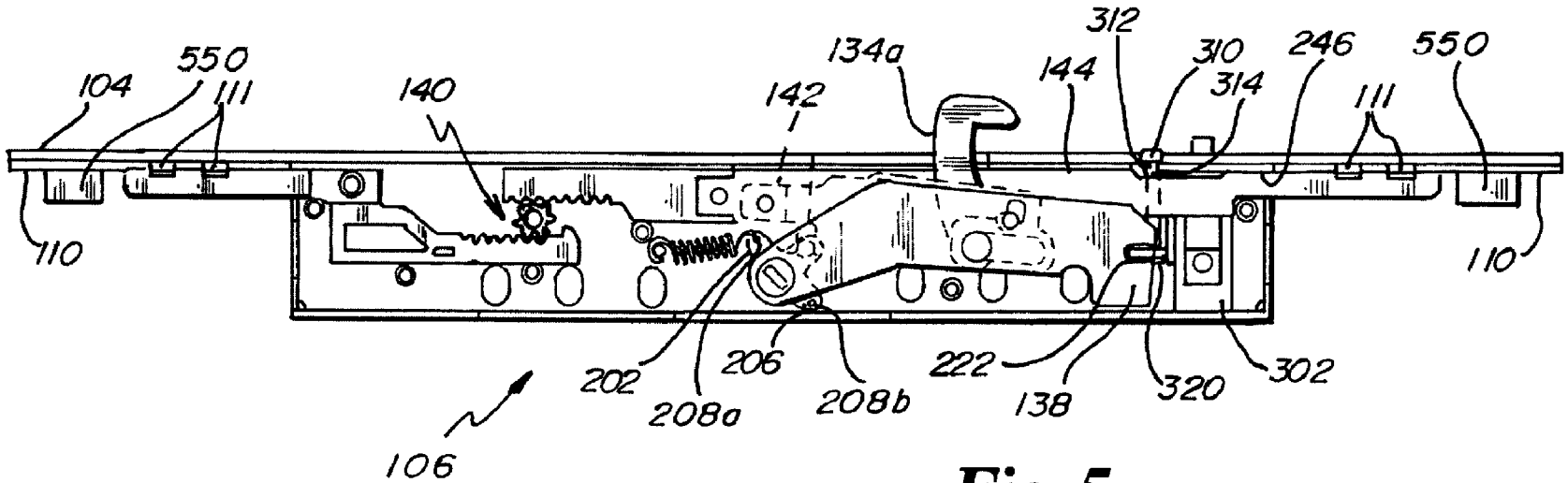
FIG. 5 is a cross-sectional view depicting an active locking device in a locked position according to an embodiment of the present disclosure.
Figure 6:
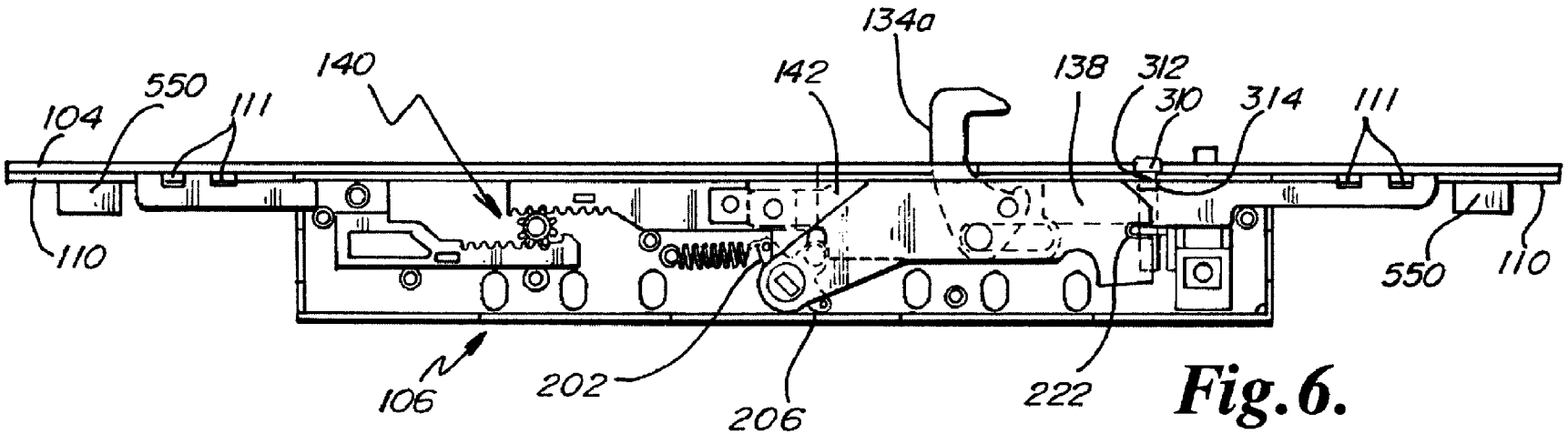
FIG. 6 is a cross-sectional view depicting an active locking device in a locked position according to an embodiment of the present disclosure.

As illustrated in FIGS. 2-6, anti-slam mechanism 150 is defined by anti-slam actuator 182, anti-slam body 302, anti-slam protrusion 304, and anti-slam spring hole 306. Anti-slam mechanism 150 generally requires that a sliding door be shut, or that anti-slam actuator 182 occupy a non-extended position, in order for adjustable latches 134 to be actuated into locked positions. Referring to FIG. 4, anti-slam body 302 fits into anti-slam recess 246 and thereby prevents lateral movement of active-lock actuator 144 when anti-slam body 302 occupies an extended position, such as, for example, when a sliding door is open. Referring to FIGS. 5-6, anti-slam body 302 is located below anti-slam recess 246 and thereby permit lateral movement of active-lock actuator 144 when anti-slam body 302 occupies an non-extended position, such as, for example, when a sliding door is closed. Anti-slam actuator hole 130 of faceplate 104 and anti-slam protrusion hole 178 of front wall 156 of active locking-device base 112 can receive anti-slam actuator 182. Anti-slam protrusion slot 198 transversely receives anti-slam protrusion 304. Anti-slam spring hole 306 can receive anti-slam spring 308.

As illustrated in FIGS. 4-9, depth-adjustment mechanism 152 can include depth-adjustment screw 180*a* and threaded depth-adjustment bolt 222. Depth-adjustment mechanism 152 generally adjusts active-lock positioner 138 to control the depth of active latch 134*a* within active locking device 106. Small depth-adjustment screw hole 176 of front wall 156 active locking-device base 112 and large depth-adjustment screw hole 132*a* of faceplate 104 can receive depth-adjustment screw 180*a*. Adjustment-bolt recess 218 of active-lock positioner 138 can receive depth-adjustment bolt 222. Depth-adjustment screw 180*a* generally includes depth-adjustment screw head 310, depth-adjustment screw neck 312, depth-adjustment screw collar 314, and depth-adjustment screw body 316 having proximal end 318 and distal end 320. At least a portion of depth-adjustment screw 180*a* is threaded so as to rotatably receive threaded depth-adjustment bolt 222.

As illustrated in FIGS. 1-3 and 7-9, upper passive locking device 108*a* and lower passive locking device 108*b* each comprise passive locking-device base 322, passive locking-device cover 324, passive latch 134*b*, passive-lock positioner 328, passive-lock drive plate 330, passive-lock actuator 332, depth-adjustment mechanism 152, and several connecting pins.

As illustrated in FIGS. 2-3 and 7-11, passive locking-device base 322 can include main wall 334, front wall 336, back wall 338, top wall 340, and bottom wall 342. Main wall 334 has small positioner-pin hole 344*a*. Extending from main wall 334 toward passive locking-device cover 324 are fastening posts 346. Fastening posts 346 can be attached to main wall 334 using a suitable connection method, including, for example, welding, press-fit, and spin-fit techniques. Front wall 336 has attachment holes 348, passive-latch opening 350 and small depth adjustment screw hole 351. Generally, attachment holes 348 of passive-locking device base 322 are aligned with attachment holes 128 of faceplate 104 so that fastening members inserted through aligned attachment holes 128, 348 to secure passive locking-device base 322 to faceplate 104. In addition, passive-latch opening 350 is generally aligned with lock channel 124 of faceplate 104 so as to allow passive latch 134*b* to freely pivot between locked and unlocked positions.

As illustrated in FIGS. 2-3, passive locking-device cover 324 can include cover plate 352 having a plurality of apertures. The apertures include positioner-pin hole 344*b* and cover-screw holes 356. Cover plate 352 has a shape so as to conformingly fit over front wall 336, back wall 338, top wall 340, and bottom wall 342 of passive locking-device base 322. Generally, positioner-pin hole 344*b* of passive locking-device cover 324 is aligned with positioner-pin 371 and with positioner-pin hole 344*a* of passive locking device base 322 and cover screw holes 356 are aligned with fastening posts 346 so as to allow passive latch 134*b* to freely pivot between locked and unlocked positions.

As illustrated in FIGS. 2-3 and 7-9, passive latch 134*b* can include hook 358, drive-pin hole 360, and large pivot-pin hole 362. Hook 358 is generally shaped so to engaged a keeper (not shown) when passive latch 134*b* is in a locked position. Drive-pin hole 360 receives drive pin 522 and large pivot-pin hole 362 can receive pivot pin 524.

As illustrated in FIGS. 2-3 and 7-9, passive-lock positioner 328 can include positioner housing 364 generally defining positioner-pin holes 366, small pivot-pin holes 368, and adjustment-bolt recesses 370. Small pivot-pin holes 368 can fixedly receive pivot pin 524. Adjustment-bolt recess 370 can rotatably receive threaded depth-adjustment bolt 222. Large positioner-pin holes 366 can rotatably receive positioner pin 371.

As illustrated in FIGS. 2-3 and 7-9, passive-lock actuator 332 can include upper engagement region 372, middle region 374, and lower region 376. Upper engagement region 372 generally defines teeth 378 and grooves 380. Middle region 374 generally defines lock-channel cover 382 and actuator shelf 384 defining actuator-pin hole 386.

As illustrated in FIGS. 2-3 and 7-9, passive-lock drive plate 330 can include drive-plate body 394 and drive-plate head 396. Drive-plate body 394 and drive-plate head 396 occupy the same plane. Drive plate body 394 generally defines pivot-pin slot 398 and drive-pin slot 400. Pivot-pin slot 398 transversely receives pivot pin 524 along a lateral axis. Drive-pin slot 400 can transversely receive drive pin 522 along longitudinal and lateral axes. Drive-plate head 396 generally defines actuator-pin hole 402. Actuator-pin hole 402 can rotationally receive actuator rivet 526.

As illustrated in FIGS. 2-3 and 7-9, depth-adjustment mechanism 152 can include depth-adjustment screw 180*b* and threaded depth-adjustment bolt 222. Depth-adjustment mechanism 152 generally adjusts passive-lock positioner 328 to control the depth of passive latch 134*b* within passive locking device 108. Small depth-adjustment screw hole 351 of front wall 336 of passive locking-device base 322 and large depth-adjustment screw hole 132*b* of faceplate 104 receive depth-adjustment screw 180*b*. Adjustment-bolt recess 370 of passive-lock positioner 328 receives threaded depth-adjustment bolt 222.

Generally, multipoint sliding door lock 100 is assembled as depicted in FIGS. 2-3. As depicted in FIGS. 12-17, as assembled, multipoint sliding door lock 100 provides an ability to receive a handle set 500 adapted to receive actuator pin 502 locatable in a plurality of positions in relation to handle-fastener holes 192. In addition, multipoint sliding door lock 100 provides an ability to actuate a plurality of lock assemblies through the operation of a single lever 504. In addition, multipoint sliding door lock 100 provides an ability to adjust the depth of adjustable latches 134 within lock assemblies 102. In addition, multipoint sliding door lock 100 provides an ability to accommodate adjustable latches 134 having varying lengths. In addition, multipoint sliding door lock 100 provides an ability to convert the rotation of crank member 136 caused by moving lever 504 through a relatively short distance into travel of upper linking member 110*a* and lower linking member 110*b* through a relatively long distance.

Figure 12:
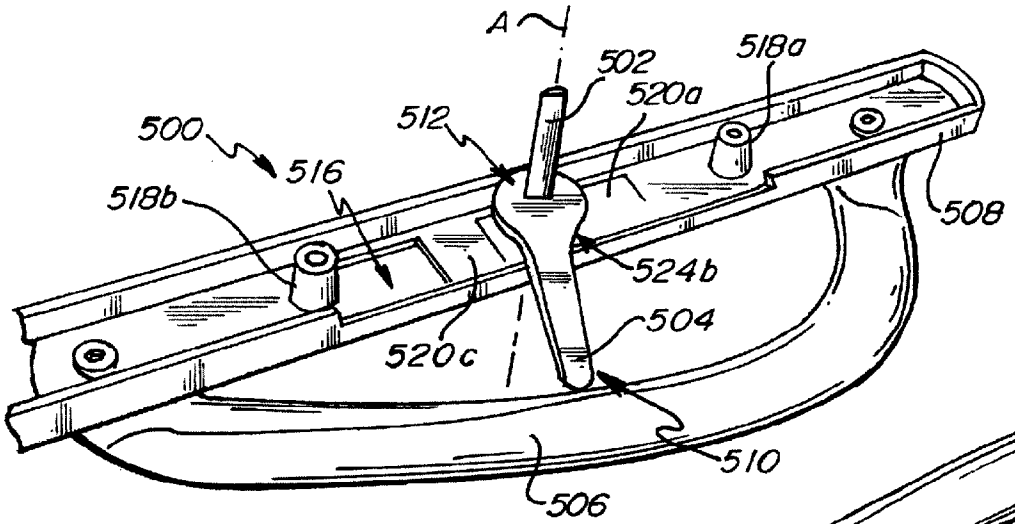
FIG. 12 is a perspective view depicting a multipoint sliding door lock handle set according to an embodiment of the present disclosure.
Figure 13:
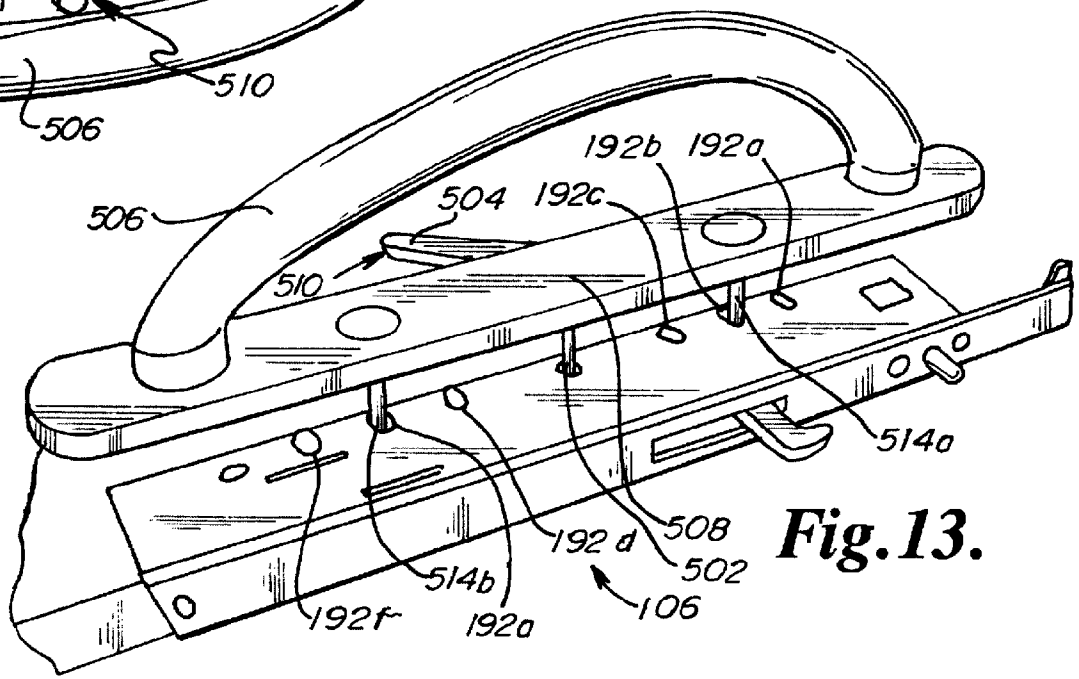
FIG. 13 is a perspective view depicting the multipoint sliding door lock handle set of FIG. 12 in relation to an active locking device according to an embodiment of the present disclosure.
Figure 14:
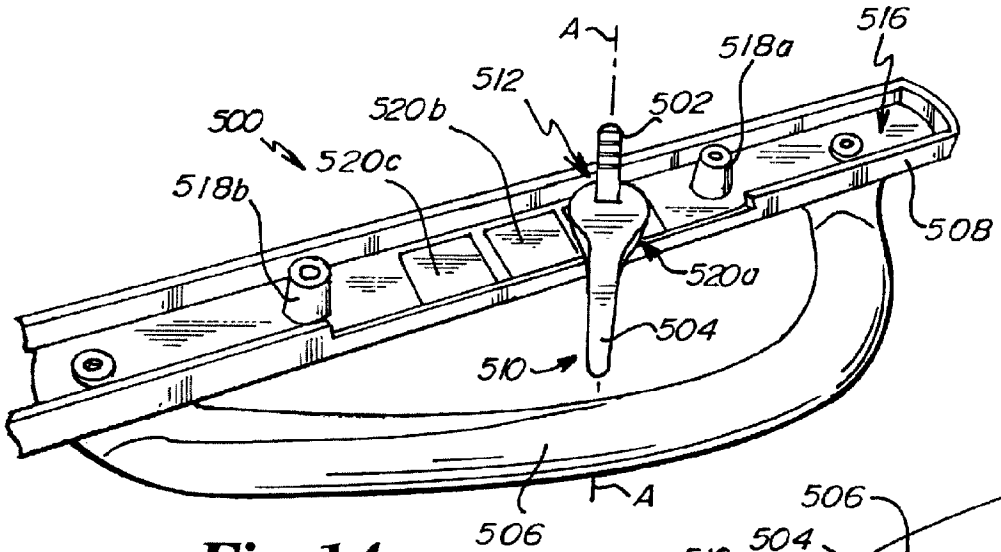
FIG. 14 is a perspective view depicting a multipoint sliding door lock handle set according to an embodiment of the present disclosure.
Figure 15:
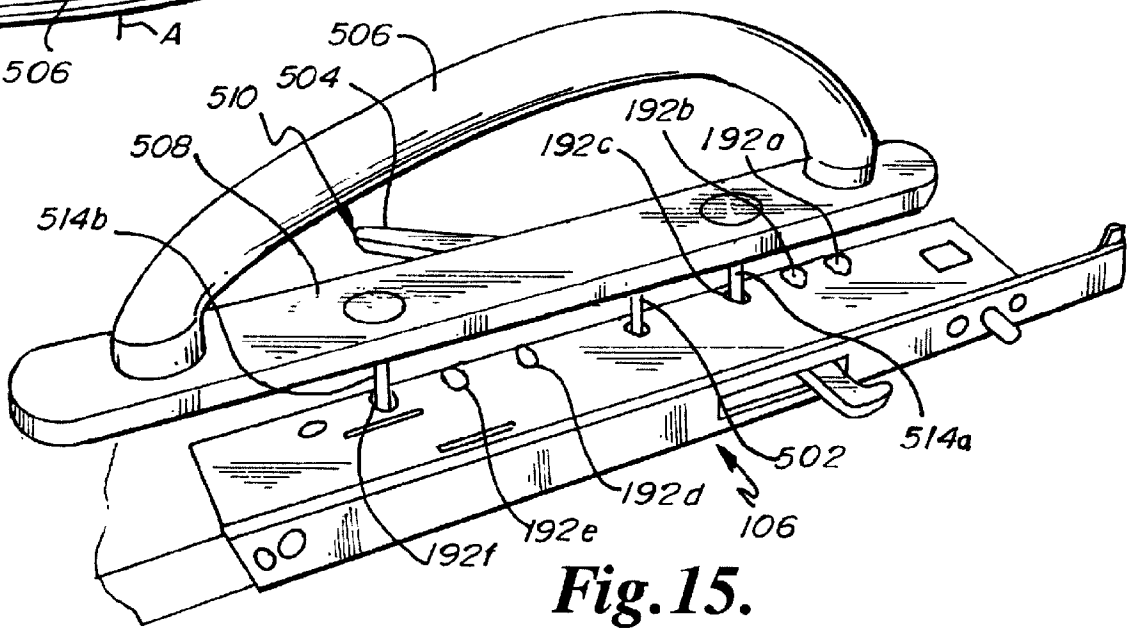
FIG. 15 is a perspective view depicting the multipoint sliding door lock handle set of FIG. 14 in relation to an active locking device according to an embodiment of the present disclosure.
Figure 16:
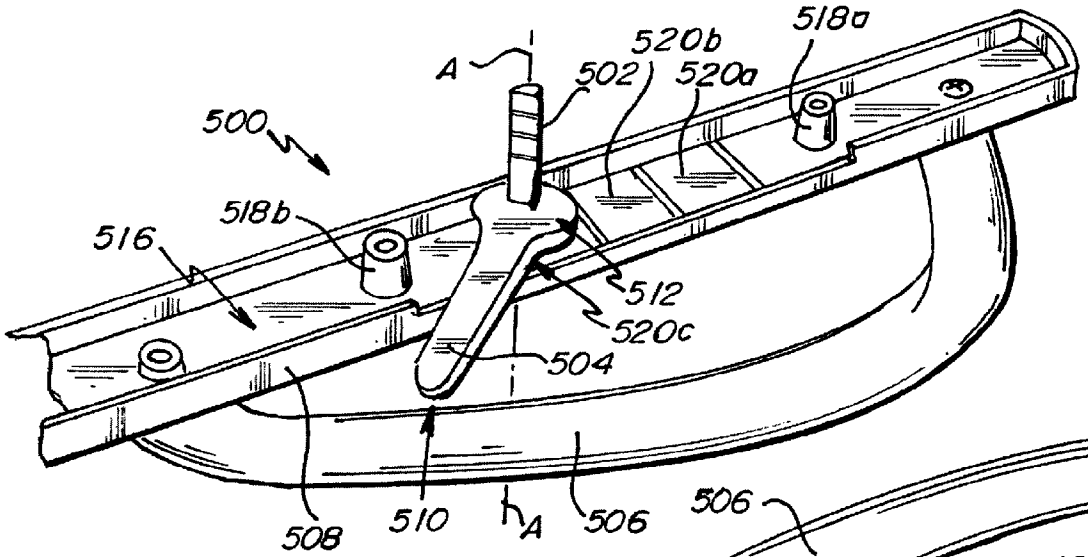
FIG. 16 is a perspective view depicting a multipoint sliding door lock handle set according to an embodiment of the present disclosure.

As depicted in FIGS. 12-17, handle set 500 can include handle 506, handle mount 508, lever 504 having distal end 510 and proximal end 512, actuator pin 502, and handle fasteners 514*a-b*. Handle mount 508 generally defines underside 516, handle-fastener housings 518 and lever-receiving channels 520. Referring to FIGS. 12, 14, and 16, lever-receiving channels 520 generally include upper lever-receiving channel 520*a*, middle lever-receiving channel 520*b*, and lower lever-receiving channel 520*c*. Actuator pin 502 is generally variably positionable relative to handle-fastener holes 192. The position of actuator pin 502 can be determined by the location of lever-receiving channels 520 on underside 516 of handle mount 508. Lever-receiving channels 520 rotatably receive lever 504 so that rotation of lever 504 within lever-receiving channel causes actuator pin 502 to rotate around axis A-A, as depicted in FIGS. 12, 14, and 16. Although FIGS. 12-17 depict the insertion of actuator pin 502 and handle fasteners 514 through actuator hole 186 and handle-fastener holes 192 of active locking-device cover 114, multipoint sliding door lock 100 is reversibly mountable to handle set 500 so that actuator pin 502 and handle fasteners 514 are inserted through actuator hole (not shown) and handle-fastener holes (not shown) of active locking-device base 112. In this flipped-mounting scenario, handle-fastener holes 192 are aligned with lever receiving channels 520 in a reversed order.

During installation or maintenance of a sliding door, it may become necessary or desirable to change the position of lever 504 on handle set 500. Multipoint sliding door lock 100 can accommodate handle set 500 having lever 504 positioned in either upper, middle, or lower lever-receiving channels 520*a-c*. The distance between handle-fastener holes 192*a-c*, handle-fastener holes 192*d-f*, and lever-receiving channels 520*a-c* is generally substantially the same, thereby enabling the handle set 500 to be positioned in two, three, or more positions relative to lock 100. The similarity of this spacing allows handle-fastener housings 518*a-b* of handle mount 508 to be aligned with handle-fastener holes 192 of active locking-device cover 114 regardless of lever-receiving channel 520 in which lever 504 is positioned.

Referring to FIG. 12, lever 504 is positioned in middle lever-receiving channel 520*b*. To accommodate the insertion of actuator pin 502 through actuator hole 186 of active locking-device cover 114, handle fastener 514*a* is inserted through handle-fastener housing 518*a* and handle-fastener hole 192*b*, while handle fastener 514*b* is inserted through handle-fastener housing 518*b* and handle-fastener hole 192*e*, as depicted in FIG. 13.

Referring to FIG. 14, lever 504 is positioned in lower lever-receiving channel 520*a*. To accommodate the insertion of actuator pin 502 through actuator hole 186 of active locking-device cover 114, handle fastener 514*a* is inserted through handle-fastener housing 518*a* and handle-fastener hole 192*c*, while handle fastener 514*b* is inserted through handle-fastener housing 518*b* and handle-fastener hole 192*f*, as depicted in FIG. 15.

Figure 17:
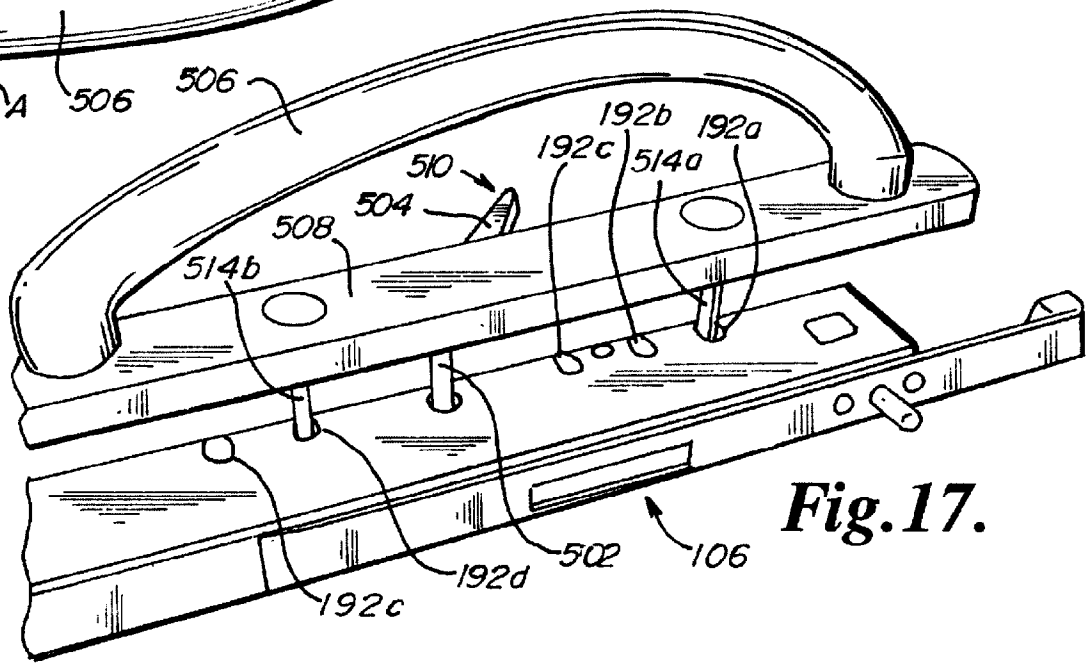
FIG. 17 is a perspective view depicting the multipoint sliding door lock handle set of FIG. 16 in relation to an active locking device according to an embodiment of the present disclosure.
Figure 18:
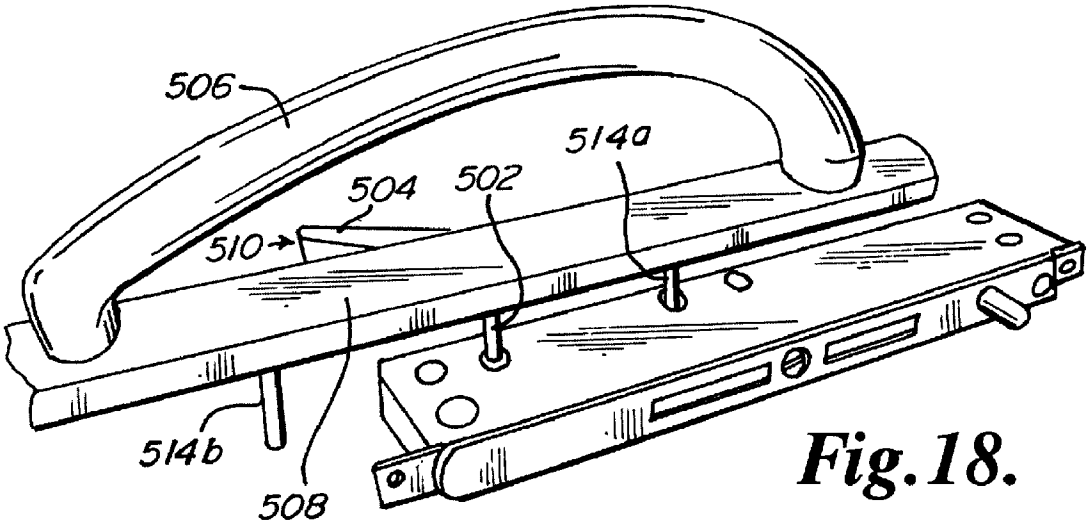
FIG. 18 is a perspective view depicting a multipoint sliding door lock handle set according to an embodiment of the present disclosure in relation to a two-point lock for a sliding door.
Figure 19:
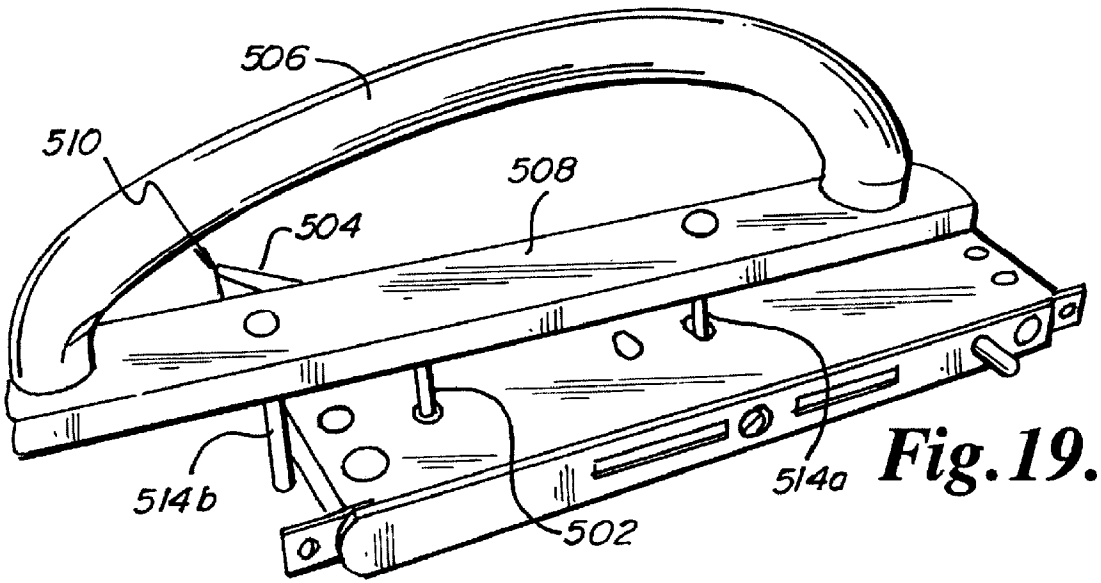
FIG. 19 is a perspective view depicting a multipoint sliding door lock handle set according to an embodiment of the present disclosure in relation to a two-point lock for a sliding door.
Figure 20:
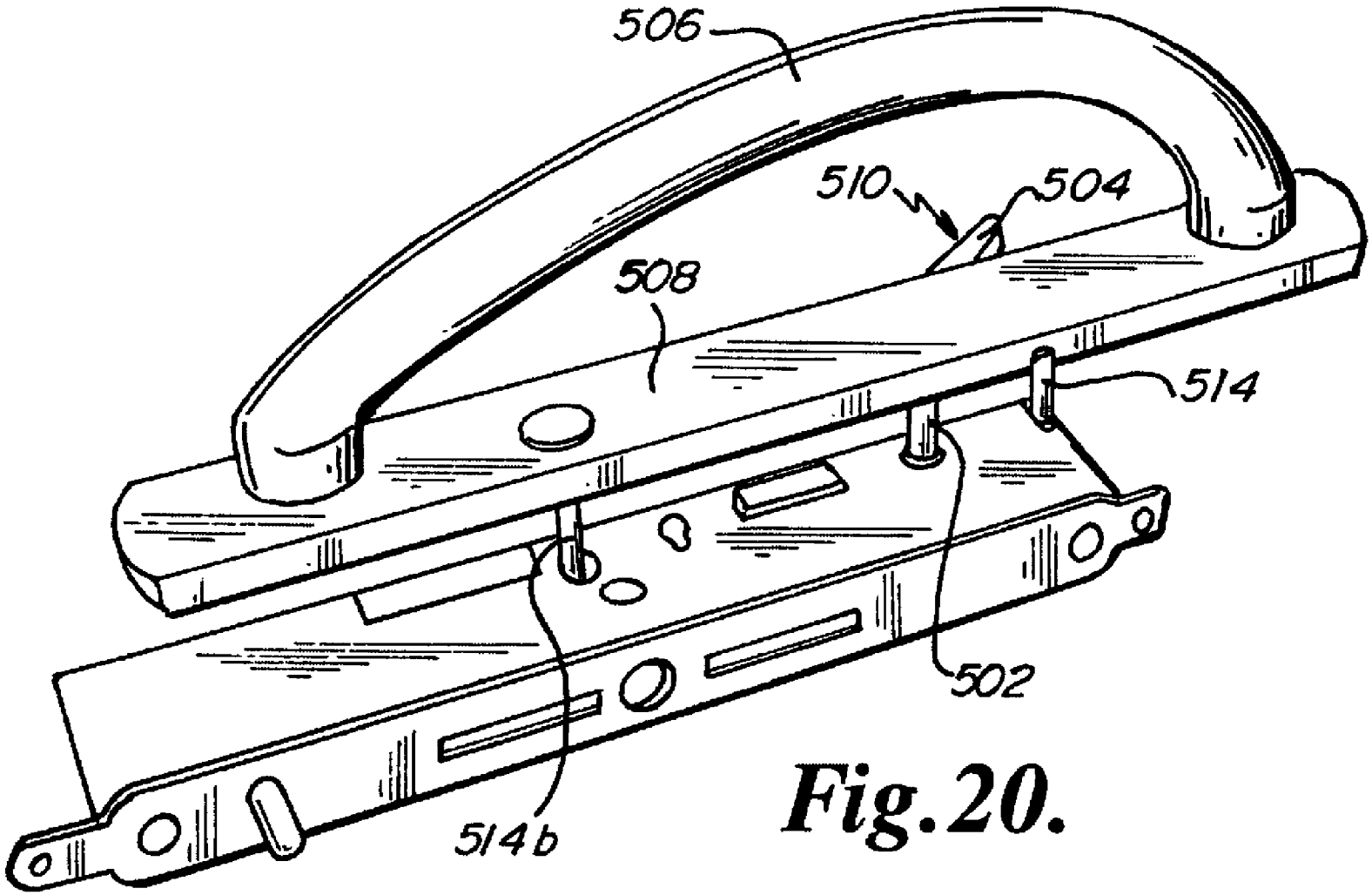
FIG. 20 is a perspective view depicting a multipoint sliding door lock handle according to an embodiment of the present disclosure in relation to a two-point lock for a sliding door.

Referring to FIG. 16, lever 504 is positioned in upper lever-receiving channel 520*c*. To accommodate the insertion of actuator pin 502 through actuator hole 186 of active locking-device cover 114, handle fastener 514*a* is inserted through handle-fastener housing 518*a* and handle-fastener hole 192*a*, while handle fastener 514*b* is inserted through handle-fastener housing 518*b* and handle-fastener hole 192*d*, as depicted in FIG. 17.

During installation or maintenance of a sliding door, it may also become necessary or desirable to adjust the distance that adjustable latches 134 extend from faceplate 104. This enables multipoint sliding door lock 100 to properly interface with the receiving component (keeper) disposed in the door jamb even if the doorway becomes out-of-square or the position of the keep in relation to faceplate 104 otherwise changes. Referring to FIGS. 4-9, multipoint sliding door lock 100 can have depth-adjustment mechanisms 152 for individually adjusting the depths of adjustable latches 134. Except for slight variations, depth-adjustment mechanisms 152 of upper passive-locking device 108*a*, active-locking device 106, and lower passive-locking device 108*b* are generally substantially similar.

Depth-adjustment mechanism 152 is generally actuated by rotating depth-adjustment screw 180, such as, for example by using a hand tool. Depth-adjustment screw 180 can be positioned about front wall 156, 336 of active or passive locking-device base 112, 116. As depicted in FIGS. 4-9, depth-adjustment screw head 310 can be positioned substantially within large depth-adjustment screw hole 132 of faceplate 104 so that only a small portion of depth-adjustment screw head 310 protrudes beyond faceplate 104. Depth-adjustment screw neck 312 can be positioned within small depth-adjustment screw hole 176, 351 of front wall 156, 336 of active or passive locking-device base 112, 116. The diameters of depth-adjustment screw head 310 and depth-adjustment screw collar 314 are generally larger than the diameter of small depth-adjustment screw holes 176, 351 so that depth-adjustment screw 180 is substantially transversely secured in place. Depth-adjustment screw neck 312 and small depth-adjustment screw hole 176, 351 are generally circular and substantially the same size so that depth-adjustment screw 180 can substantially freely rotate within small depth-adjustment screw holes 176, 351. Also, depth-adjustment screw head 310 and large depth-adjustment screw hole 132 are generally circular and substantially the same size so that depth-adjustment screw 180 can substantially freely rotate within large depth-adjustment screw hole 132.

Depth-adjustment bolt 222 can be threaded onto distal end 320 of depth-adjustment screw body 316. In active locking device 106, depth-adjustment bolt 222 is generally situated in depth-adjustment bolt recess 218 of active lock positioner 138. In upper and lower passive locking devices 108*a-b*, depth-adjustment bolt 222 is generally situated in depth-adjustment bolt recess 370 of passive lock positioner 328. The size and shape of depth-adjustment bolt recess 218, 370 substantially prevent depth-adjustment bolt 222 from rotating in relation to depth-adjustment bolt recesses 218, 370.

As depth-adjustment screw 180 is rotated, depth-adjustment screw head 310 and depth-adjustment screw collar 314 substantially maintain the position of depth-adjustment screw 180 within active locking device 106 or upper or lower passive locking device 108*a* or 108*b*. Depth-adjustment screw 180*b* in passive locking device 108 may be larger than depth-adjustment screw 180 in active locking device 106. Since the position of depth-adjustment screw 180 is substantially transversely fixed and depth-adjustment bolt 222 is rotationally fixed, rotation of depth-adjustment screw 180 can effect lateral displacement of depth-adjustment bolt 222. Depending upon the direction of the threads on depth-adjustment screw body 316 and depth-adjustment bolt 222 and the direction of rotation of depth-adjustment screw 180, depth-adjustment screw bolt 222 can be displaced toward front wall 156, 336 and back wall 158, 338 of active and passive locking-device base 106,108. Depth-adjustment mechanism 152 can also be adapted so that depth-adjustment bolt 222 is operably connected to anti-slam mechanism 150. When depth-adjustment bolt 222 is operably connected to anti-slam mechanism 150, displacement of depth-adjustment bolt 222 can effect a similar displacement of anti-slam body 302, thereby affecting the position of anti-slam actuator 182 within faceplate 104.

Depth-adjustment mechanism 152 can be positioned in active locking device 106, as depicted in FIG. 4-6. Referring to FIG. 5, active latch 134*a* occupies a non-extended position when depth-adjustment bolt 222 is situated at or near distal end 320 of depth-adjustment screw body 316. As depth-adjustment screw head 310 is rotated, depth-adjustment bolt 222 is displaced toward front wall 156 of active locking-device base 112. Displacement of depth-adjustment bolt 222 toward front wall 156 causes active-lock positioner 138 to rotate about crank-member body 200 so that pivot-pin holes 216 move toward front wall 156. As small pivot-pin holes 216 move toward front wall 156, the corresponding movement of pivot pin 220, which is operably attached to active latch 134*a*, causes active latch 134*a* to extend through latch channel 124 and active-latch opening 179 to move away from back wall 158. Referring to FIG. 6, active latch 134*a* can occupy an extended position when depth-adjustment bolt 222 is situated at or proximal distal end 320 of depth-adjustment screw body 316. In this manner, the depth of active latch 134*a* within active locking device 106 can be adjusted. The range adjustment is generally limited to the range of rotational movement of active-lock positioner 138 between back wall 158 and front wall 136 of active locking-device base 112.

Figure 7:
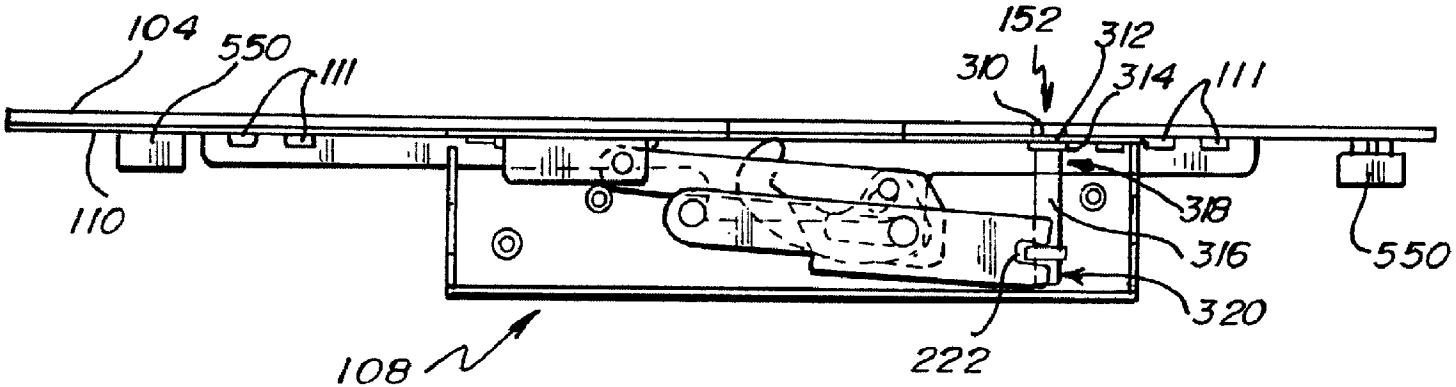
FIG. 7 is a cross-sectional view depicting a passive locking device in an unlocked position according to an embodiment of the present disclosure.
Figure 8:
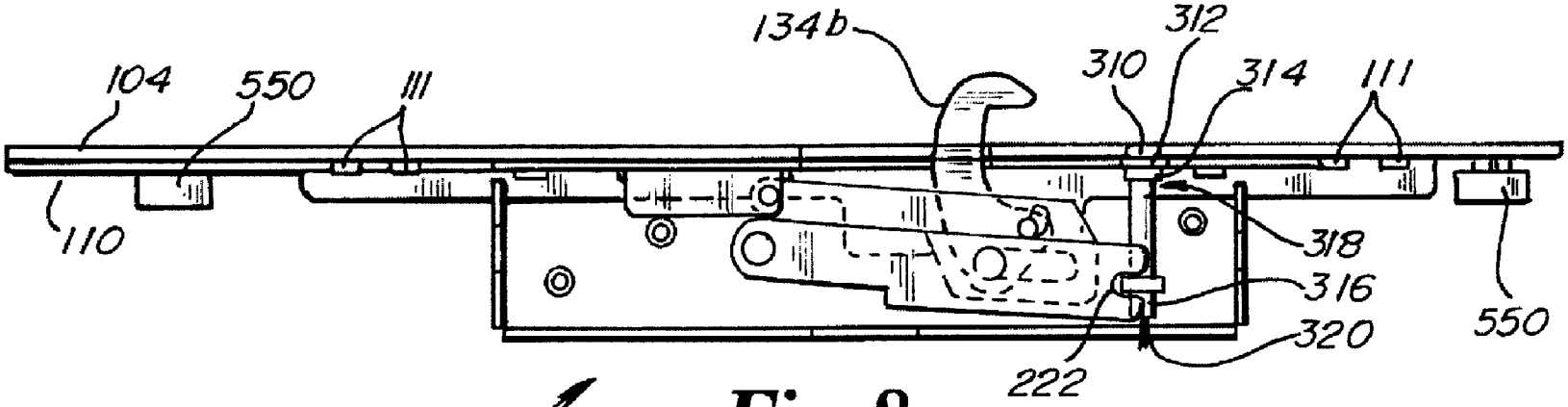
FIG. 8 is a cross-sectional view depicting a passive locking device in a locked position according to an embodiment of the present disclosure.
Figure 9:
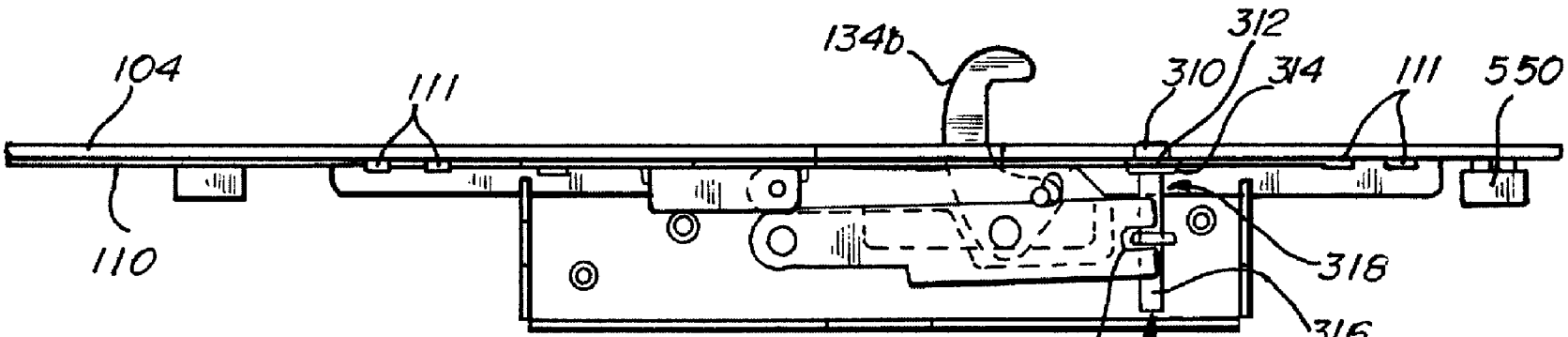
FIG. 9 is a cross-sectional view depicting a passive locking device in a locked position according to an embodiment of the present disclosure.
Figure 10:
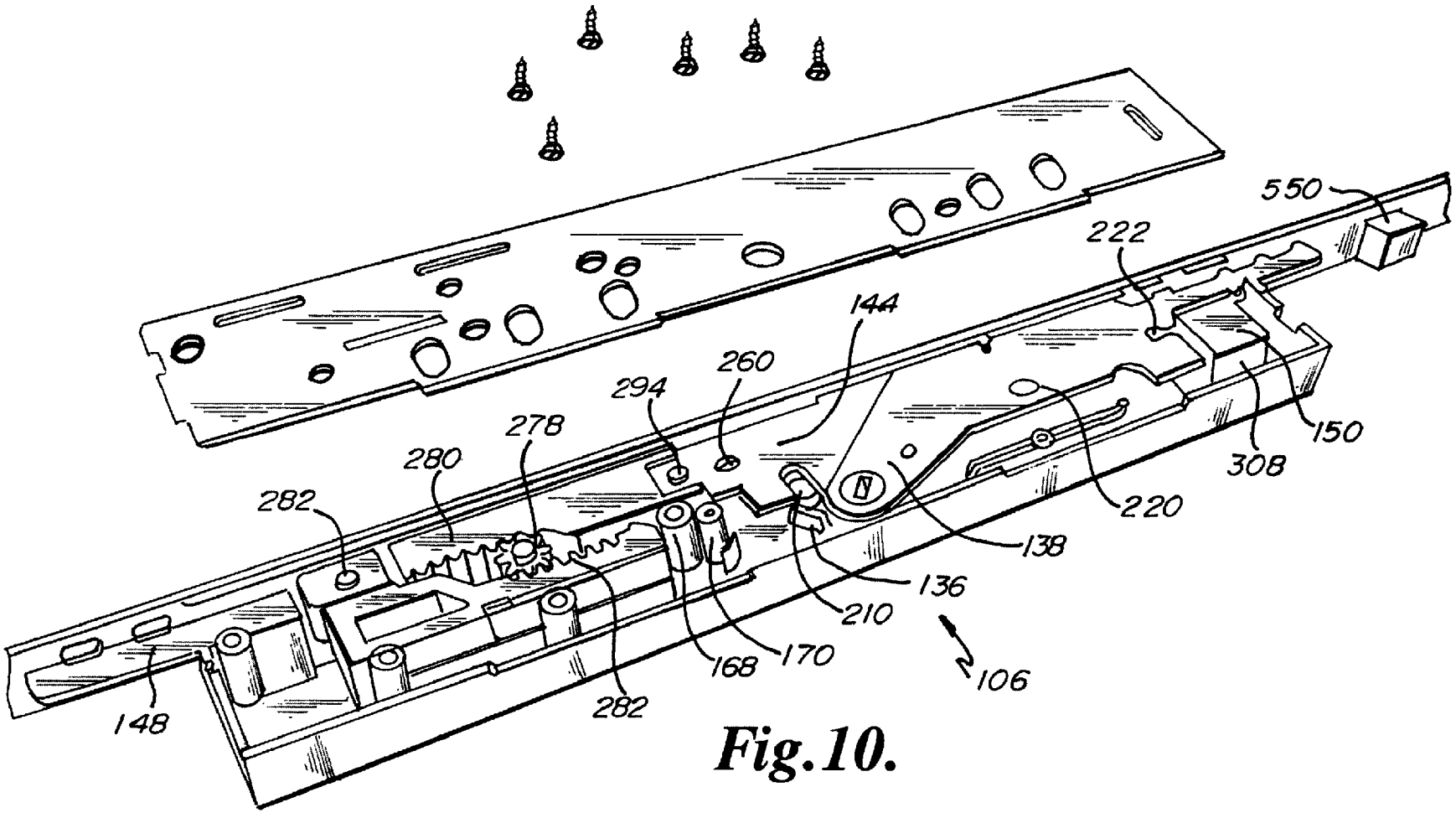
FIG. 10 is a perspective view depicting a partially disassembled active locking device in an unlocked position according to an embodiment of the present disclosure.
Figure 11:
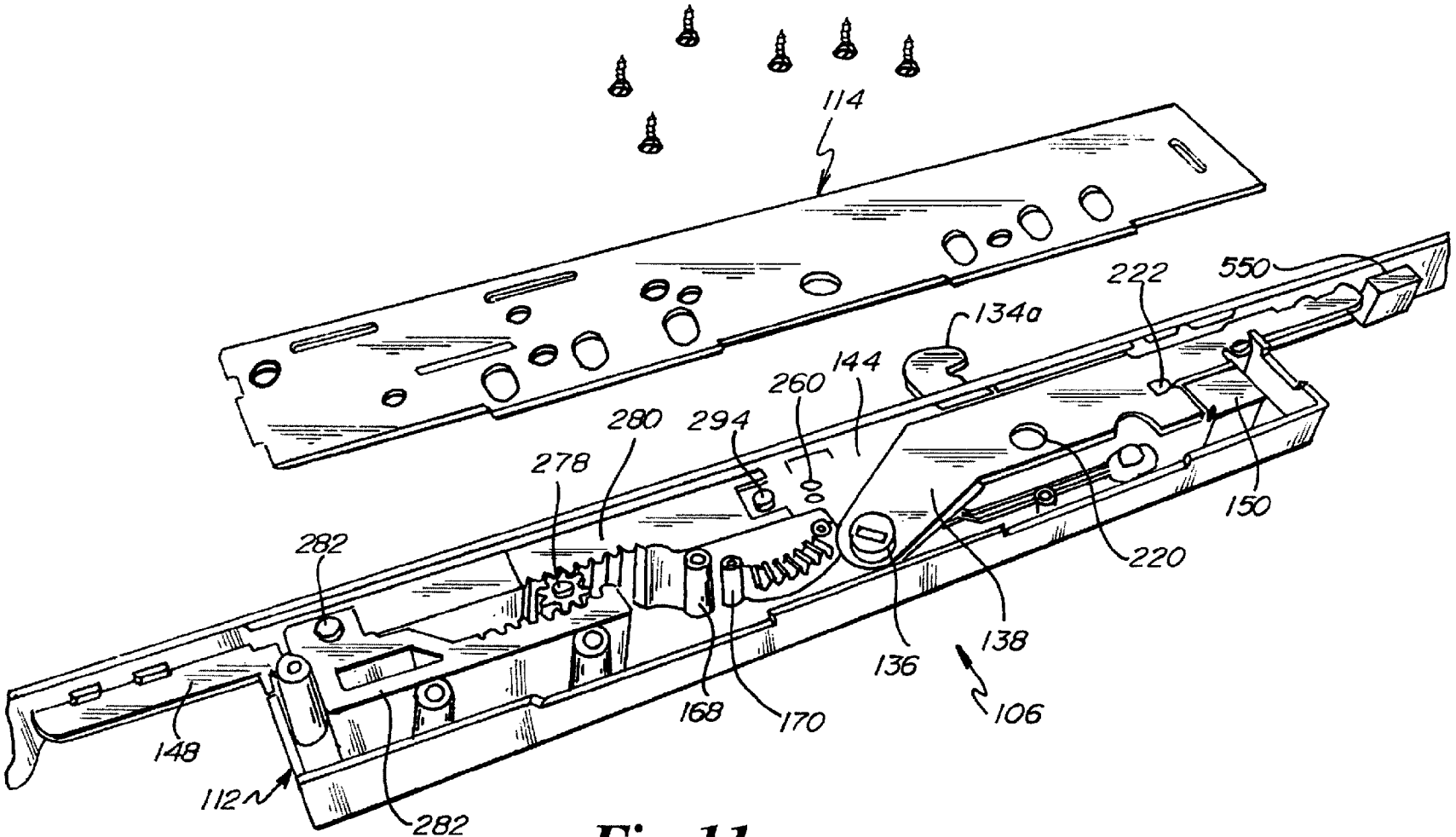
FIG. 11 is a perspective view depicting a partially disassembled active locking device in a locked position according to an embodiment of the present disclosure.

Depth-adjustment mechanism 152 can be positioned in upper or lower passive locking device 108*a* or 108*b*, as depicted in FIG. 7-9. Referring to FIG. 8, passive latch 134*b* occupies a non-extended position when depth-adjustment bolt 222 is situated at or near distal end 320 of depth-adjustment screw body 316. As depth-adjustment screw head 310 is rotated, depth-adjustment bolt 222 is displaced toward front wall 336 of passive locking-device base 322. Displacement of depth-adjustment bolt 222 toward front wall 336 causes passive-lock positioner 328 to rotate about positioner pin 371 so that small pivot-pin holes 368 move toward front wall 336. As small pivot-pin holes 368 move toward front wall 336, the corresponding movement of pivot pin 524, which is operably attached to passive latch 134*b*, causes passive latch 134*b* to extend through latch channel 124 and passive-latch opening 350 to move away from back wall 338. Referring to FIG. 9, passive latch 134*b* can occupy an extended position when depth-adjustment bolt 222 is away from distal end 320 and toward proximal end 318 of depth-adjustment screw body 316. In this manner, the depth of passive latch 134*b* within passive locking device 108*b* can be adjusted. The range adjustment is generally limited to the range of rotational movement of passive-lock positioner 328 between back wall 338 and front wall 336 of passive locking-device base 322.

The following description primarily describes operation of multipoint sliding door lock 100 in causing adjustable latches 134 to occupy a locked position. One skilled in the art will recognize, however, that reversing the direction of movement of the components describes operation of multipoint sliding door lock 100 in causing adjustable locks to occupy an unlocked position without departing from the spirit or scope of the invention. To open or close a sliding door, it may be necessary to lock or unlock the sliding door. Multipoint sliding door lock 100 permits a user to actuate a plurality of adjustable latches 134 that can engage or disengage a plurality of keepers through a single manipulative step of moving lever 504. When a sliding door is open, anti-slam actuator 182 of anti-slam mechanism 150 generally occupies an extended position, as depicted in FIG. 4. Anti-slam mechanism 150 generally functions by inhibiting lateral movement of active-lock actuator 144. If active-lock actuator 144 is unable to move laterally in a direction parallel to faceplate 104, crank member 136 cannot actuate active locking device 106, upper passive locking device 108*a*, or lower passive locking device 108*b*.

Anti-slam spring 308 situated between anti-slam body 150 and back wall 158 of active locking-device base 112 exerts a force on anti-slam body 150 that causes anti-slam actuator 182 to extend through anti-slam actuator holes 130, 178 of front wall 156 of active locking-device base 112 and faceplate 104. If an opposing force is not applied to anti-slam actuator 182, anti-slam actuator 182 remains in an extended position. Anti-slam body 150 can, however, be pushed toward back wall 158 of active locking-device base 112 to enable lever 504 to actuate active locking device 104. For example, by closing a sliding door against a door jamb, the force exerted against the sliding door causes anti-slam body 150 to compress anti-slam spring 308 and move toward back wall 158. When front surface of anti-slam body 150 is pushed past back edge of anti-slam recess 246, active-lock actuator 144 can be freely extended toward bottom end 122 of faceplate 104, as depicted in FIGS. 5-6.

If active-lock actuator 144 is freely extendable, crank member 136 can be made to rotate. Since proximal end 512 of lever 504 is disposed to active locking device 106 by actuator pin 502, raising or lowering distal end 510 of lever 504 through an arc defined by the length of lever 504 causes actuator pin 502 to rotate. Rotation of actuator pin 502 generally produces a corresponding rotation of crank member 136 around axis A-A within crank holes 214 of active-lock positioner 138.

In the unlocked position, crank member 136 is generally oriented so that top crank arm 202 is situated against or near back wall 158 of active locking-device base 112, as depicted in FIG. 4. Depending upon how lever 504 is disposed to actuator pin 502, raising or lowering distal end 510 of lever 504 rotates crank member 136 so that bottom crank arm 206 becomes situated against or near back wall 158 of active locking-device base 112. As crank member 136 rotates around axis A-A, middle crank arm 204 is also caused to rotate, moving from an upward orientation to a downward orientation, as depicted in FIGS. 4-5. As middle crank arm 204 rotates, crank-arm protrusion 210 moves away from top wall 160 and toward bottom wall 162 of active locking-device base 112. Crank-arm protrusion 210, which is situated within crank-protrusion recess 236 of active-lock actuator 144, can thereby cause active-lock actuator 144 to move toward bottom end 122 of faceplate 104. Crank-protrusion recess 236 is generally elongated so as to accommodate the lateral displacement of crank-arm protrusion 210 as crank-arm protrusion 210 moves longitudinally toward bottom wall 162. The longitudinal displacement of active-lock actuator 144 is generally defined by an arc traversed by crank-arm protrusion 210, which is defined by the length of middle crank arm 204.

Longitudinal displacement of active-lock actuator 144 directly affects the motion of three additional components. Active-lock actuator 144 generally longitudinally displaces active-lock drive plate 142 and front gear drive 280 toward bottom wall 162 and lower linking member 110*b* toward bottom end 122 of faceplate 104. Since the purpose of lower linking member 110*b* is to actuate lower passive locking device 108*b*, additional description of lower linking member 110*b* will follow in connection with description of lower passive-locking device 108*b*.

Active-lock actuator 144 is operably connected to active-lock drive plate 142 by actuator rivet 260, Actuator rivet 260 is fixedly secured through large actuator-pin hole 258 in drive-plate head 250 of active-lock drive plate 142 and small actuator-pin hole 234 in active-lock actuator 144. As active-lock actuator 144 is longitudinally displaced, active-lock drive plate 142 is generally longitudinally displaced by a similar distance and in a similar direction. The direction of movement of active-lock drive plate 142 is maintained by pivot pin 220. Pivot pin 220 is fixedly secured through small pivot-pin holes 216 of active-lock positioner 138, rotatably secured through large pivot-pin hole 266 of active latch 134*a*, and transversely secured in pivot-pin slot 252 of active-lock drive plate 142. As depicted in FIG. 3, active-lock drive plate 142 is secured beneath active latch 134*a* within active-lock positioner 138. Pivot-pin slot 252 in drive-plate body 248 of active-lock drive plate 142 enables active-lock drive plate 142 to longitudinally slide about pivot pin 220.

Displacement of active-lock drive plate 142 toward bottom wall 162 generally exerts a force upon drive pin 256. As depicted in FIG. 3, drive pin 256 is rotatably secured through drive-pin hole 264 of active latch 134*a* and transversely secured through drive-pin slot 254. The force exerted upon drive pin 256 causes active latch 134*a* to rotate about pivot pin 220 and causes drive pin 256 to be displaced within drive-pin slot 254 of active-lock drive plate 142. The shape of pivot-pin slot 252 generally permits drive-pin slot 254 to be displaced so as to accommodate the arc-shaped displacement of drive pin 256 created by the rotation of active latch 134*a* about pivot pin 220. The interaction of the arc-shape of drive pin slot 254, drive pin 256, and pivot pin 220 prevents latch 134*a* from backdriving. As active latch 134*a* rotates about pivot pin 220, hook 262 moves through active-latch opening 179 in active locking-device base 112 and latch channel 124 in faceplate 104 so as to occupy a locked position, as depicted in FIGS. 5-6.

Active-lock actuator 144 is also operably connected to front gear drive 280 by front-gear protrusion 294. As depicted in FIGS. 2-3, actuator extension 230 at upper engagement region 224 of active-lock actuator 144 is situated within front-gear recess 292 of front gear drive 280 so that front-gear protrusion 294 is fixedly secured through front-gear protrusion hole 232 of active-lock actuator 144. As active-lock actuator 144 is longitudinally displaced, front gear drive 280 is generally longitudinally displaced by a similar distance and in a similar direction. The direction of movement of front gear drive 280 is maintained by front-gear guides 290. Front-gear guides 290 are transversely secured through front-gear guide slots 164*a-b* of main wall 154 and plate cover 184. Front-gear guide slots 164*a-b* allow front gear drive 280 to longitudinally slide toward or away from top wall 160 and bottom wall 162.

Displacement of active-lock actuator 144 toward bottom wall 162 generally exerts a force upon front gear drive 280 that causes front gear drive 280 to be displaced toward bottom wall 162. Displacement of front gear drive 280 causes gears 288 of front gear drive 280 to engage gears 286 of cog 278. Cog 278 is rotatably secured in place by cog protrusions 284. Cog protrusions 284 are rotatably secured in cog-protrusion holes 166*a-b* of main wall 154 and cover plate 184.

Gears 286 of cog 278 can also engage gears 296 of back gear drive 298. Generally, as the displacement of front gear drive 280 causes cog 278 to rotate, the rotation of cog 278 displaces back gear drive 282 in a direction opposite the direction of displacement of front gear drive 280, or toward top wall 160 of active locking-device base 112. To ensure that lower linking member 110*b* and upper linking member 110*a* are displacement by a substantially similar amount, the gear ratio between gears 288 of front gear drive 280 and gears 286 of cog 278 and the gear ratio between gears 296 of back gear drive 282 and gears 286 of cog 278 are 1:1.

Back gear drive 282 is operably connected to upper linking-member engager 148 by back-gear protrusion 300. Back gear protrusion 300 is fixedly secured through back-gear protrusion hole 276 in lower region 270 of upper linking-member engager 148. As back gear drive 282 is longitudinally displaced, upper linking-member engager 148 is generally longitudinally displaced by a similar distance and in a similar direction.

Upper linking-member engager 148 and lower-linking member engager 146 of active-lock actuator 144 generally operate in a similar manner to actuate passive latches 134*b*. Upper linking-member engager 148 has teeth 272 and grooves 274 matingly engaged to teeth 111 and grooves 113 of upper linking member 110*a*. As upper-linking member engager 148 is displaced toward top end 120 of faceplate 104, upper-linking member engager 148 can cause upper linking member 110*a* to be displaced by a similar amount and in a similar direction. Similarly, lower linking-member engager 146 has teeth 242 and grooves 244 matingly engaged to teeth 111 and grooves 113 of lower linking member 110*b*. As lower-linking member engager 146 is displaced toward lower end 122 of faceplate 104, lower-linking member engager 146 can cause upper linking member 110*a* to be displaced by a similar amount and in a similar direction. Referring to FIGS. 2-3, upper linking member 110*a* and lower linking member 110*b* are generally transversely secured to faceplate 104 by retainers 550 and retainer rivets 552. Retainer rivets 552 are fixedly secured through retainer-screw holes 554 of retainer 550 and mounting holes 128 of faceplate 104. Upper and lower linking members 110*a-b* can be slidably disposed intermediate faceplate 104 and retainer 550 such that retainer rivet 552 is situated within link-member channel 556. Upper and lower linking members 110*a-b* can thereby be secured proximal to faceplate 104 so as to slide about retainer rivet 552.

The description that follows primarily describes the operation of lower passive locking device 108*b*. One skilled in the art will recognize, however, that the direction of operation of upper passive locking device 108*a* can be similarly described without departing from the spirit or scope of the invention. Referring to FIGS. 2-3, lower linking member 110*b* is operably connected to upper engagement region 372 of passive-lock actuator 332. Lower linking member 110*b* has teeth 111 and groves 113 matingly engaged to teeth 378 and grooves 380 of passive-lock actuator 332. As lower linking member 110*b* is displaced toward bottom end 122 of faceplate 104, lower linking member 110*b* can cause passive-lock actuator 332 to be displaced by a similar amount and in a similar direction.

Passive-lock actuator 332 is operably connected to passive-lock drive plate 330 by actuator rivet 526. Actuator rivet 526 is fixedly secured through large actuator-pin hole 402 in drive-plate head 396 of passive-lock drive plate 330 and small actuator-pin hole 386 in actuator shelf 384. As passive-lock actuator 332 is longitudinally displaced, passive-lock drive plate 330 is generally longitudinally displaced by a similar distance and in a similar direction. The direction and movement of passive-lock drive plate 330 is maintained by pivot pin 524. Pivot pin 524 is fixedly secured through small pivot-pin holes 368 of passive-lock positioner 328, rotatably secured through large pivot-pin hole 362 of passive-latch 134*b*, and transversely secured in pivot-pin slot 398 of passive-lock drive plate 330. As depicted in FIG. 3, passive-lock drive plate 330 is secured above passive latch 134*b* within passive-lock positioner 328. Pivot-pin slot 398 in body drive-plate 394 of passive-lock drive plate 330 allow passive-lock drive plate 330 to longitudinally slide about pivot pin 524.

Displacement of passive-lock drive plate 330 toward bottom wall 342 of passive locking-device base 322 generally exerts a force upon drive pin 522. As depicted in FIG. 3, drive pin 522 is rotatably secured through drive-pin hole 360 of passive latch 134*b* and transversely secured through drive-pin slot 400. The force exerted upon drive pin 256 can cause passive latch 134*b* to rotate about pivot pin 524 and cause drive pin 522 to be displaced within drive-pin slot 400 of passive-lock drive plate 330. The shape of pivot-pin slot 400 generally permits drive-pin 522 to be displaced as to accommodate the arc-shaped displacement of drive pin 522 created by the rotation of passive latch 134*b* about pivot pin 524. As passive latch 134*b* rotates pivot pin 524, hook 358 moves through passive latch opening 350 in active latch device-base 322 and latch channel 124 in faceplate 104 so as to occupy a locked position, as depicted in FIG. 5-6.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A multipoint lock mechanism for a door comprising:

a faceplate adapted to be secured to an edge of a door;

a handle assembly including a pair of handle fasteners spaced apart at a first spacing distance, the handle assembly further including a rotatable handle actuator pin selectively positionable in a plurality of locations on the handle assembly relative to the handle fasteners;

an active locking assembly fastened to the faceplate, the active locking assembly including:

a base having a main wall and at least one laterally extending side wall;

a cover plate secured to the base and generally opposing the main wall, defining a housing, each of the main wall of the base and the cover plate defining first and second sets of handle fastener apertures, each of the first and second sets of handle fastener apertures defining first, second, and third apertures, wherein the distance between the first apertures, the second apertures, and the third apertures is the same as the first spacing distance, wherein when the handle actuator pin is selectively positioned in one of the plurality of positions on the handle assembly, the handle actuator pin is received in the handle actuator pin aperture, one of the handle fasteners is received in one of the first, second, or third fastener apertures of one of the sets and the other handle fastener is received in the other one of the first, second, or third aperture of the other set; and an active latch received in the housing, the active latch shiftable between a first extended position relative to the faceplate, and a second non-extended position relative to the faceplate;

a first depth adjustment mechanism operably coupled to the active latch; and at least one passive locking assembly operably coupled to the active locking assembly and fastened to the faceplate, the at least one passive locking assembly having a passive latch shiftable between a first extended position relative to the faceplate, and a second non-extended position relative to the faceplate, the at least one passive locking assembly including a second depth adjustment mechanism operably coupled to the passive latch, wherein the active latch and the passive latch shift simultaneously between the first extended position and the second non-extended position upon rotation of the actuator pin of the handle assembly in the handle actuator pin aperture, each of the first depth adjustment mechanism and the second depth adjustment mechanism including:

a lock positioner operably coupled to the corresponding latch, the lock positioner defining an adjustment-bolt recess;

a depth-adjustment screw defining a screw head and a screw body; and a depth-adjustment bolt threadingly and rotatably engaged with the screw body and positioned within the adjustment-bolt recess, wherein displacement of the depth-adjustment bolt along the screw body causes displacement of the lock positioner and the corresponding latch relative to the faceplate, such that a position of the threaded depth-adjustment bolt on the screw body defines a depth position of the corresponding latch relative to the faceplate, whereby the first depth adjustment mechanism and the second depth adjustment mechanism enable the active latch and the passive latch to be independently depth-adjustable relative to the faceplate.

2. The multipoint lock mechanism according to claim 1, wherein the active locking assembly further comprises:

an active-lock actuator defining a crank-protrusion recess;

a crank member having a crank-arm protrusion positioned within the crank-protrusion recess; and an active-lock drive plate operably coupled to the active lock actuator and the active latch, wherein rotation of the actuator pin of the handle assembly causes the crank member to rotate thereby causing the crank-arm protrusion to displace longitudinally along the crank-protrusion recess of active-lock actuator causing longitudinal displacement of the active-lock actuator and the active lock drive plate, thereby causing active latch to shift between the first extended position and the second non-extended position.

3. The multipoint lock mechanism according to claim 2, the mechanism further comprising at least one linking member operably coupled to the active latch and one of the plurality of passive latches, and wherein the active locking assembly further comprises:

the active-lock actuator further defining at least one linking-member engager operably engaged with one of the at least one linking members, wherein rotation of the actuator pin of the handle assembly causes longitudinal displacement of the active-lock actuator such that the at least one linking-member engager actuates a corresponding linking member, causing shifting of the corresponding passive latch between the first extended position and the second non-extended position simultaneously with the shifting of the active latch between the first extended position and the second non-extended position.

4. The multipoint lock mechanism according to claim 2, wherein the active locking assembly further comprises an anti-slam mechanism adapted to selectively position the active latch in first extended position, wherein the anti-slam mechanism includes:

a spring-loaded anti-slam actuator shiftable between a first extended position and a second depressed position relative to the faceplate, and an anti-slam body coupled to the anti-slam actuator, wherein the anti-slam body is engaged within an anti-slam recess of the active-lock actuator when the anti-slam actuator is in the first extended position such that lateral displacement of the active-lock actuator is prevented and the active latch is in second non- extended position, and wherein the anti-slam body is disengaged within the anti-slam recess when the anti-slam actuator is in the second depressed position such that lateral displacement of the active-lock actuator is permitted to shift the active latch between the first and second positions.

5. A lockable sliding door assembly mountable within a door jamb, the sliding door assembly comprising:

a door frame defining an opening;

a door slidably shiftable in a track on the door frame to open and close the opening defined by the door frame, the door including a vertically oriented stile having a mortise in an edge thereof;

a handle assembly including a lever and an actuator pin operably coupled to the lever, wherein the lever is selectively positionable along a body of the handle assembly between at least two positions, the handle assembly further including a pair of handle fasteners spaced apart at a first spacing distance; and a multipoint lock assembly received in the mortise, wherein the multipoint lock assembly includes:

a faceplate fastened to the edge of the sliding door having the mortise;

an active locking assembly fastened to the faceplate, the active locking assembly including:

a housing defining first and second sets of handle fastener apertures, each of the first and second sets of handle fastener apertures defining first, second, and third apertures, and a handle actuator pin aperture, wherein the distance between the first apertures, the second apertures, and the third apertures is the same as the first spacing distance, wherein when the handle actuator pin is selectively positioned in one of the plurality of positions on the handle assembly, the handle actuator pin is received in the handle actuator pin aperture, one of the handle fasteners is received in one of the first, second, or third fastener apertures of one of the sets and the other handle fastener is received in the other one of the first, second, or third aperture of the other set;

an active latch received in the housing and shiftable between a first locked position wherein the active latch is releasably engaged with a corresponding keeper in the door jamb, and a second unlocked position wherein the active latch is disengaged with the corresponding keeper; and a plurality of passive locking assemblies operably coupled to the active locking assembly and fastened to the faceplate, each of the plurality of passive locking assemblies having a passive latch shiftable between a first locked position wherein the passive latch is releasably engaged with a corresponding keeper in the door jamb, and a second unlocked position wherein the passive latch is disengaged with the corresponding keeper, wherein the active latch and each of the passive latches shift simultaneously between the first locked position and the second unlocked position upon an application of force to the lever of the handle assembly when the sliding door is in the closed position;

wherein the active locking assembly comprises a first depth adjustment mechanism operably coupled to the active latch, and each passive locking assembly comprises a second depth adjustment mechanism operably coupled to the corresponding passive latch such that the active latch and the passive latch of each of the plurality of passive locking assemblies is independently depth-adjustable relative to the faceplate, each of the first depth adjustment mechanism and the second depth adjustment mechanisms comprising:

a lock positioner operably coupled to the corresponding latch, the lock positioner defining an adjustment-bolt recess;

a depth-adjustment screw defining a screw head and a screw body; and a depth-adjustment bolt threadingly and rotatably engaged with the screw body and positioned within the adjustment-bolt recess, wherein displacement of the depth-adjustment bolt along the screw body causes displacement of the lock positioner and the corresponding latch perpendicular to the faceplate, such that a position of the depth-adjustment bolt on the screw body defines a depth position of the corresponding latch relative to the faceplate.

6. The lockable sliding door assembly according to claim 5, wherein the active locking assembly further comprises:

an active-lock actuator defining a crank-protrusion recess;

a crank member having a crank-arm protrusion positioned within the crank-protrusion recess; and an active-lock drive plate operably coupled to the active lock actuator and the active latch, wherein rotation of the actuator pin of the handle assembly causes the crank member to rotate thereby causing the crank-arm protrusion to displace longitudinally along the crank- protrusion recess of active-lock actuator causing longitudinal displacement of the active-lock actuator and the active lock drive plate, thereby causing active latch to shift between the first locked position and the second unlocked position.

7. The lockable sliding door assembly according to claim 6, the mechanism further comprising at least one linking member operably coupled to the active latch and one of the plurality of passive latches, and wherein the active locking assembly further comprises:

the active-lock actuator further defining at least one linking-member engager operably engaged with one of the at least one linking members, wherein rotation of the actuator pin of the handle assembly causes longitudinal displacement of the active-lock actuator such that the at least one linking-member engager actuates a corresponding linking member, causing shifting of the corresponding passive latch between the first locked position and the second unlocked position simultaneously with the shifting of the active latch between the first locked position and the second unlocked position.

8. The lockable sliding door assembly according to claim 6, wherein the active locking assembly further comprises an anti-slam mechanism adapted to selectively position the active latch in first locked position, wherein the anti-slam mechanism includes:

a spring-loaded anti-slam actuator shiftable between a first extended position and a second depressed position relative to the faceplate, and an anti-slam body coupled to the anti-slam actuator, wherein the anti-slam body is engaged within an anti-slam recess of the active-lock actuator when the anti-slam actuator is in the first extended position such that lateral displacement of the active-lock actuator is prevented to maintain the active latch in second unlocked position, and wherein the anti-slam body is disengaged within the anti-slam recess when the anti-slam actuator is in the second depressed position such that lateral displacement of the active-lock actuator is permitted to shift the active latch between the unlocked and locked positions.

* * * * *

UNITED STATES PATENT AND TRADEMARK OFFICE

CERTIFICATE OF CORRECTION

PATENT NO. : 8,398,126 B2
APPLICATION NO. : 12/124823
DATED : March 19, 2013
INVENTOR(S) : Yoshikazu Nakanishi et al.

It is certified that error appears in the above-identified patent and that said Letters Patent is hereby corrected as shown below:

On the Title Page

Abstract, Line 13:
Delete "lever, Actuation" and insert --lever. Actuation--.

In the Specification

Column 1, Lines 38-39:
Delete "door locks, however" and insert --door locks--.

Column 2, Line 15:
Delete "include depth-adjustment" and insert --include a depth-adjustment--.

Column 5, Line 32:
Delete "The apertures includes" and insert --The apertures include--.

Column 6, Line 15:
Delete "Drive plate" and insert --Drive-plate--.

Column 6, Line 44:
Delete "transversely receives" and insert --transversely receive--.

Column 6, Line 67:
Delete "permit" and insert --permits--.

Column 7, Line 46:
Delete "to secure passive" and insert --secure passive--.

Signed and Sealed this
Second Day of September, 2014

Michelle K. Lee

Michelle K. Lee
*Deputy Director of the United States Patent and Trademark Office*

Column 9, Line 55:
Delete “of the keep in” and insert --of the keeper in--.

Column 11, Lines 3-4:
Delete “or proximal distal end 320” and insert --or proximal to distal end 320--.

Column 13, Line 46:
Delete “are displacement” and insert --are displaced--.

In the Claims

Column 16, Line 14:
Delete “recess of active-lock” and insert --recess of the active-lock--.

Column 18, Line 19:
Delete “recess of active-lock” and insert --recess of the active-lock--.

Column 18, Line 20:
Delete “thereby causing active latch” and insert --thereby cause the active latch--.